US005250351A

United States Patent [19]

Kondou et al.

[11] Patent Number: 5,250,351

[45] Date of Patent: Oct. 5, 1993

[54] ELASTIC WARP KNITTED FABRIC AND METHOD OF MANUFACTURING SAME

[75] Inventors: Toshiyuki Kondou, Osaka; Yoshinori Morifuji, Shiga, both of Japan

[73] Assignee: Asahi Kasei Kogyo Kabushiki Kaisha, Osaka, Japan

[21] Appl. No.: 906,865

[22] Filed: Jul. 1, 1992

[30] Foreign Application Priority Data

Jul. 2, 1991 [JP] Japan ..... 3-186954

[51] Int. Cl.[5] ..... D04B 23/18; D06B 3/28; D06B 21/02; D06P 5/02

[52] U.S. Cl. ..... 428/231; 8/491; 8/494; 8/149.1; 8/149.2; 8/149.3; 28/167; 28/169; 34/23; 34/34; 66/81; 66/84 R; 66/192; 68/5 C

[58] Field of Search ..... 8/491, 494, 149.1, 149.2, 8/149.3; 28/167, 169; 34/23, 34; 66/81, 84 R, 192; 428/231

[56] References Cited

U.S. PATENT DOCUMENTS

| | | | |
|---|---|---|---|
| 3,552,154 | 1/1971 | Lesley | 66/192 |
| 3,552,155 | 1/1971 | Hortung | 66/192 |
| 3,910,075 | 10/1975 | Holliday | 66/192 |
| 3,922,888 | 12/1975 | Patterson | 66/192 |
| 4,044,575 | 8/1977 | Krug | 66/192 |
| 4,064,712 | 12/1977 | Sayre et al. | 66/192 |
| 4,096,609 | 6/1978 | Sayre | 66/192 |
| 4,103,485 | 8/1978 | Brues | 66/192 |
| 4,164,050 | 8/1979 | Stakelbeck | 68/5 C |
| 4,248,064 | 2/1981 | Odham | 66/192 |
| 4,351,076 | 9/1982 | von der Eltz | 8/149.1 |
| 4,365,424 | 12/1982 | Hoersch | 68/5 D |
| 4,483,032 | 11/1984 | Christ | 68/178 |
| 4,658,604 | 4/1987 | Wilson | 66/192 |
| 4,786,549 | 11/1988 | Richards | 428/253 |

FOREIGN PATENT DOCUMENTS

| | | |
|---|---|---|
| 0078022 | 10/1982 | European Pat. Off. . |
| 2112611 | 10/1972 | Fed. Rep. of Germany . |
| 51-88682 | 7/1976 | Japan . |
| 52-37873 | 3/1977 | Japan . |
| 60-224847 | 11/1985 | Japan . |
| 61-174458 | 8/1986 | Japan . |
| 63-29030 | 6/1988 | Japan . |
| 63-36385 | 7/1988 | Japan . |
| 1590064 | 5/1981 | United Kingdom . |

OTHER PUBLICATIONS

Japan Research Association for Textile End-Uses, vol. 27, No. 1 (1986) pp. 31-36.

"Process Technique" vol. 23, No. 6, (Jun. 1989) pp. 379-385.

*Primary Examiner*—James C. Cannon

*Attorney, Agent, or Firm*—Finnegan, Henderson, Farabow, Garrett & Dunner

[57] ABSTRACT

An elastic warp knitted fabric having a pulling out force for pulling out an elastic yarn from the knitted fabric of 30 g or more, and in which a shape of a sinker loop of a nonelastic yarn is maintained as a bulge shape after an application of a dyeing and finishing treatment. This elastic warp knitted fabric can be manufactured by using a specially prepared dyeing and finishing treatment, so that the sinker loop of the nonelastic yarn can be maintained in the treatment.

12 Claims, 13 Drawing Sheets

ELASTIC WARP KNITTED FABRIC AND METHOD OF MANUFACTURING SAME

BACKGROUND OF THE INVENTION

1 Field of the Invention

This invention relates to an elastic knitted fabric including an elastic yarn and able to be used for innerwear, outerwear, sportwear, an industrial material or the like.

2. Description of the Related Art

An elastic warp knitted fabric including an elastic yarn such as a urethane elastic yarn, an elastic textured yarn or the like has a broad application due to a superior elongation, elastic recovery and tightening force thereof up to now. For innerwear, a sufficient elongation, elastic recovery and tightening force are required, to adjust to a figure of a human body and protect the human body from unnecessary vibration generated by body movement. In sportwear, an optimum elongation, elastic recovery and tightening force, which do not obstruct a free movement of the human body, are required, and thus the elastic warp knitted fabric including the elastic yarn such as the urethane elastic yarn, the elastic textured yarn or the like has been used for almost all applications.

Nevertheless, although a conventional elastic warp knitted fabric has a superior stretchability in a wale direction, there is no warp knitted fabric having a superior balance between an elongation in a wale direction and an elongation in a course direction, i.e., the warp knitted fabric having a ratio between the elongation in the wale direction and the elongation in the course direction which is near to 1, and thus when clothing is made from the conventional warp knitted fabric, a cutting direction of the warp knitted fabric must be taken into consideration.

Japanese Unexamined Patent Publication (Kokai) No. 60-224847 and Japanese Unexamined Utility Model Publication No. 51-88682 disclose elastic warp knitted fabric having the same knitting weave, i.e., one weave of a satin net, as that of the warp knitted fabric in accordance with the present invention, but there is no description of a shape of a sinker loop of the elastic knitted fabric in the above two publications, and it is well known that a shape of the sinker loop largely depends on a type of dyeing and finishing process used. Further, there is no description of a type of dyeing and finishing process used for the elastic warp knitted fabrics, in the two above publications.

A conventional dyeing and finishing process of a common elastic warp knitted fabric has been disclosed, for example, in Japanese Unexamined Patent Publications (Kokai) No. 61-174458 and No. 60-224847. Namely, Japanese Unexamined Patent Publication (Kokai) No. 61-174458 discloses that a relaxation treatment, a dehydration treatment, a preset treatment, a scouring and bleaching process, a warm water rinsing treatment, a dyeing treatment, warm water rinsing treatment and a finishing set treatment are sequentially applied to an elastic warp knitted fabric in which an elastic yarn is inserted. The Japanese Unexamined Patent Publication (Kokai) No. 60-224847 discloses a dyeing and finishing process using the above-described sequential treatments in which a preset treatment and a finishing set treatment of the temperature of 170° C. or more, preferably between 180° C. and 200° C., are applied to the elastic warp knitted fabric under a stretching treatment in the wale and course directions. Nevertheless, the ratio between the wale elongation and the course elongation of the elastic warp knitted fabric obtained becomes 2 or more, as described, for example in Japan Research Association for Textile End-Uses Vol. 27, No. 1, 1986. Accordingly, when clothing is made from the conventional elastic warp knitted fabric, it is necessary to select as suitable cutting direction due to an inferior balance between the wale elongation and the course elongation. As can be clarified in the above description of the prior art, the sinker loops are set to a stretched state in the elastic warp knitted fabric having an inferior balance between the wale elongation and the course elongation, and thus a density of yarns constituting the knitted fabric becomes coarse.

Namely, a sinker loop of a nonelastic yarn binding two adjacent elastic yarns is formed from a needle loop side of an elastic yarn to a needle loop side of another adjacent elastic yarn, or from a sinker loop side of an elastic yarn to a needle loop side of another adjacent elastic yarn in a power net. After an application of the dyeing and finishing process, the sinker loop formed by the nonelastic yarn is stretched, and thus a knitted fabric becomes coarse because a distance between the two adjacent elastic yarns is widened. In this state, i.e., a state that an angle $\theta$ of the sinker loop defined by a method described in detail later is less than 48°, even if this knitted fabric is stretched, the knitted fabric does not have enough elongation to be stretched, and thus a knitted fabric having only a lower elongation is obtained. This feature may appear strongly in the course direction of the knitted fabric.

The above described matter teaches that an elastic warp knitted fabric having a superior balance between the wale elongation and the course elongation is a warp knitted fabric having an elongation sufficient to be stretched in the course direction, and it is necessary that the sinker loop formed by the nonelastic yarn has a bulge shape.

The bulge shape of the sinker loop formed by the nonelastic yarn is generally kept in the grey fabric, but the bulge shape of the sinker loop is eliminated by a tension applied in a course direction in the dyeing treatment or by a force used for applying a set in a wale direction, to provide a dimensional stability to the knitted fabric and to prevent creases generated in the dyeing process When the dyeing and finishing treatments are applied to a satin net, a sinker loop of a nonelastic yarn binding two adjacent elastic yarns in a sinker loop side thereof is also stretched, i.e., a radius of curvature of the sinker loop of the nonelastic yarn and defined by a method described in detail later is infinity, a distance between two adjacent elastic yarns is widened, and a density of the knitted fabric becomes coarse. Nevertheless, the sinker loop formed by the nonelastic yarn in a grey fabric of the satin net has essentially a bulge shape, and a balance between the wale elongation and the course elongation of this knitted fabric is superior.

Consequently, the sinker loop formed by the nonelastic yarn in a grey fabric of the elastic warp knitted fabric has essentially a bulge shape and the knitted fabric has a superior balance between the wale elongation and the course elongation. Namely, in a state of a grey fabric, the nonelastic yarn has an angle $\theta$ of a sinker loop larger than 48° in the power net, and a radius A of curvature of sinker loop of 3000 $\mu$m or less in the satin net.

The grey fabric of the elastic warp knitted fabric has other problems. One being that the grey fabric of the knitted fabric has an irregularity between a density in a central portion of the warp knitted fabric and a density in a portion near to a selvage of the warp knitted fabric. This irregularity is generated because the grey fabric is wound in a state such that a strain generated in the grey fabric during a knitting operation is maintained in a rolled fabric, a surface of the warp knitted fabric is made flat by a pressure applied to the warp knitted fabric during the winding operation, and there is a difference of the pressure between the center portion and the portion near to the selvage of the warp knitted fabric. Accordingly, a difference of the pressure between the center portion and the portion near to the selvage of the warp knitted fabric causes an irregularity of a density between the center portion and the portion near to the salvage of the warp knitted fabric. And then the balance between the wale elongation and the course elongation becomes irregular between the center portion and the portion near to the selvage of the warp knitted fabric.

Another problem is that the elastic yarn in the grey fabric is not tightly held in a knitted weave of the warp knitted fabric, because the nonelastic yarn is not shrunk in the grey fabric which is not applied with a dyeing and finishing process, and the nonelastic yarn cannot apply a tightening force on the elastic yarn. Accordingly, when a stretching and shrinking operation is repeated on the warp knitted fabric, the elastic yarn is likely to move in the grey fabric of the warp knitted fabric, and thus a fabric distortion caused by a dislocation of the elastic yarn from the original position may be generated.

Japanese Technical Magazine "Process Technique" Vol. 23, No. 6 (1989), page 379 to 385 discloses a technique using an air flow dyeing machine, and that a warp knitted fabric of a polyamide yarn and a polyurethane elastomer yarn is dyed by the air flow dyeing machine, but this reference does not disclose in detail a structure of the warp knitted fabric, conditions of treatment applied to the warp knitted fabric, and an effect caused by this treatment.

The inventors of the present application took note of a bulge of a sinker loop formed by a nonelastic yarn in the grey fabric, and carried out intensive research to obtain a warp knitted fabric in which the bulge of the nonelastic yarn is kept as much as possible, an irregularity of a balance between a wale elongation and a course elongation is made as small as possible, and a fabric distortion is alleviated, and thus found that a warp knitted fabric having a stretchable quality in a course direction, and a superior balance between the wale elongation and the course elongation, can be obtained by applying a specific bulge to a sinker loop of the nonelastic yarn.

SUMMARY OF THE INVENTION

The primary object of the present invention is to provide an elastic warp knitted fabric having bulge sinker loops formed by a nonelastic yarn, a superior balance between a wale elongation and a course elongation, and able to be sewn without consideration of a direction of a cutting of the knitted fabric, and having no fabric distortion.

Another object of the present invention is to provide a method of manufacturing the elastic warp knitted fabric.

The primary object of the present invention can be attained by an elastic warp knitted fabric in which an elastic yarn is inserted to sinker loops of a ground knitted weave constituted by a nonelastic yarn, characterized in that the elastic warp knitted fabric is knitted so that the following conditions a and b are satisfied:

a. A pulling out force for pulling out the elastic yarn at the pulling speed of 10 cm/min from the warp knitted fabric is 30 g or more;

b. A shape of the sinker loop of the nonelastic yarn in the warp knitted fabric satisfies the following equations (1) and (2).

$$\frac{L_0(\max) - L_0(\min)}{L_0(\text{mean})} \times 100 < 15 \quad (1)$$

$$\frac{\Sigma\left\{\frac{L - L_0}{L_0}\right\}}{15} \times 100 > 4 \quad (2)$$

wherein: the definitions of $L_0$, $L_0(\max)$, $L_0(\min)$ $L_0(\text{mean})$ and L are as follows:

$L_0$: a distance between two points formed by that perpendicular lines projecting from each center of two adjacent elastic yarns toward a straight line connecting the each center of the two adjacent elastic yarns are crossed with a curve arranged substantially at a middle portion of a sinker loop of the nonelastic yarn, $L_0(\max)$: a maximum value of a fifteen value of $L_0$, $L_0(\min)$: a minimum value of the fifteen value of $L_0$, $L_0(\text{mean})$: a mean value of the fifteen value of $L_0$, L: a length of a segment of a curve arranged substantially in a middle portion of a sinker loop of the nonelastic yarn which is cut by two perpendicular lines projecting from each center of the two adjacent elastic yarns.

Although it is sufficient that a value expressed by the equation (2) is 4 or more when the elastic warp knitted fabric is a satin net, the value expressed by the equation (2) must be 5 or more when the elastic warp knitted fabric is a power net.

In a method used for manufacturing the elastic warp knitted fabric in accordance with the present invention, a grey fabric of the elastic warp knitted fabric is knitted in such a manner that the elastic yarn is inserted to sinker loops of a ground knitted weave constituted by a nonelastic yarn by a warp knitting machine, a relaxation treatment using at least one selected from a group of steam, water and air is applied to the grey fabric in a dyeing machine using a flowing gas as an energy for propelling a fabric, a wet heat process comprising a scouring treatment and a dyeing treatment, is applied to the relaxed fabric in the flowing gas dyeing machine, and finally, a finishing set is applied to the obtained knitted fabric.

It is preferable to further apply a preset treatment to the relaxed grey fabric when the elastic warp knitted fabric is a satin net.

DESCRIPTION OF THE PREFERRED EMBODIMENTS

Figure 1:
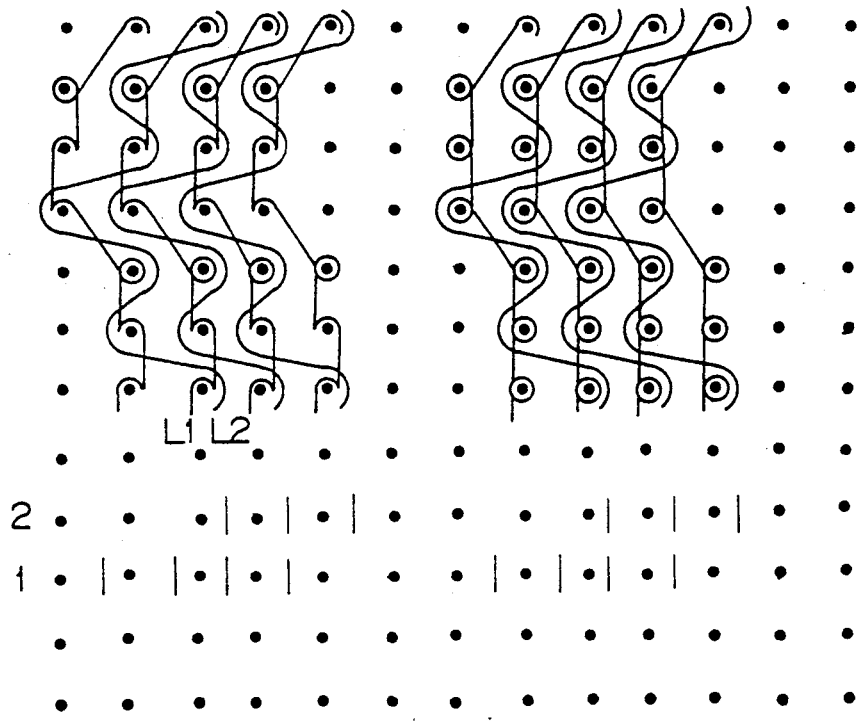
FIG. 1 is a knitted weave view illustrating an example of a six course satin net used for an elastic warp knitting fabric in accordance with the present invention.

The present invention will be described hereinafter in connection with the accompanying drawings showing embodiments of the present invention.

An elastic yarn used in the present invention is a yarn obtained by spinning an elastic high polymer having an urethane group in the molecule thereof and obtained by reacting, in a reaction stage or multiple reaction stage, a one polymer, two polymer or more of a substantial linear polymer having a molecular weight of between 600 and 5000 and having a hydroxyl group on both ends thereof, such as a polyesterdiol, a polylactondiol, a polythioetherdiol, a polyesteramidediol a polyetherdiol and a polycarbonate diol with an organic diisocyanate, a chain extender of multifunctional compound having active hydrogen atoms such as a hydrazine, a polyhydrazide, a polyol, a polyamine, a hydroxylamine, and a water and an end terminator of monofunctional compound having one active hydrogen atom such as a dialkylamine.

Further, the elastic yarn can be obtained by spinning a prepolymer composed of a substantial linear polyol having molecular weight of between 500 and 5000 and having a hydroxyl group on both ends thereof, and an organic diisocyanate, under a reaction with a chain extender having a multifunctional active hydrogen atom and an end terminator having a monofunctional active hydrogen atom.

The elastic yarn can be optionally mixed, if desirable, with an organic formulating ingredient or an inorganic formulating ingredient having a specific chemical structure useful for a conventional polyurethane polymer composition, for example, an anti-gas fading agent, a ultraviolet absorbing agent, an anti-oxidant, a mold proofing agent, a finely divided inorganic particle such as barium sulfide, magnesium oxide, a calcium silicate, or zinc oxide, and a surface tack eliminator such as calcium stearate, magnesium stearate, polytetrafluoroethylene, organopolysiloxane or the like.

It is preferable in the present invention to use an elastic yarn having a denier of 490 or less and a breaking elongation of between 500% and 800%.

It also is preferable in the present invention to use a nonelastic yarn having an initial modulus of between 35 g/d and 50 g/d, a breaking tenacity of between 2 g/d and 10 g/d, and a breaking elongation of between 10% and 60%, and a filament or a spun yarn of a synthetic fiber such as a polyamide fiber, a polyester fiber or the like, a regenerated fiber such as a viscose rayon, an acetate rayon or the like, or a natural fiber such as cotton, wool, flax fiber, silk or the like can be used as the nonelastic yarn.

Especially, it is preferable to use the polyamide fiber for innerwear and sportwear, due to superior softness, heatstability, and durability when worn and washed.

The polyamide fiber can be typically obtained from a homopolymer comprised of a polyhexamethylene adipamide of 95% by weight and polymerized from a hexamethylenediamine and an adipic acid or a homopolymer comprised of a polycapramide polymerized from a $\epsilon$-caprolactum. Further the polyamide fiber can be manufactured from a homopolymer or a copolymer obtained by a conventional polymerization method and a blend thereof.

The polyamide fiber having various types of cross section, e.g., circular, Y-letter type, L-letter type, triangular, a rectangular, pentagonal, hollow, asteroid, and an irregular cross section having a plurality of convex or concave portions on a peripheral portion of the fiber and obtained by applying a weight reduction treatment, can be used.

Further, the polyamide fiber can be supplemented with a conventional additive such as a dulling agent, a stabilizer, an antistatic agent or the like.

Further, it is possible to use a polymer having a polymerization degree in a range useful for manufacturing a fiber.

Several manufacturing methods can be used to obtain the polyamide fiber to be used for knitting the elastic warp knitting fabric in accordance with the present invention. Namely, the polyamide fiber may be manufactured by spinning the polymer at the winding speed of between 1000 m/min and 1500 m/min and then applying a drawing operation, or by spinning and directly winding the polymer at the extruding speed of 3500 m/min or more with or without the drawing operation.

When a high tenacity nylon fiber having the tenacity of between 7 g/d and 10 g/d is used, it is preferably possible to provide a thin elastic warp knitting fabric having a superior burst strength, and tear strength.

An elastic warp knitted fabric in accordance with the present invention, i.e., an elastic warp knitted fabric in which an elastic yarn is inserted into sinker loops of a ground knitted weave constituted with a nonelastic yarn, can be obtained by repeating a knitting process in which the elastic yarn is inserted in a wale direction, and the nonelastic yarn is twined around the elastic yarn at every several courses of the ground knitted weave, and further, twined around another elastic yarn positioned in an adjacent wale by using a raschel knitting machine, and thus a portion of the sinker loop of the nonelastic yarn connecting the two adjacent elastic yarns is arranged on a surface of the elastic warp knitted fabric and gives an appearance having a superior luster. The above elastic warp knitted fabric is generally known as a satin net and a power net. A four course satin net, a six course satin net, or a ten course satin net are generally used as the satin net, but other satin nets can be applied to the present invention.

FIG. 1 shows a knitted weave view of the six satin net. This six satin net can be obtained by an inserting weave in which at least one reed used for guiding the elastic yarn is moved over at least two knitting needles, and a nylon yarn is guided by the reed $L_1$ and a polyurethane elastic yarn is guided by the reed $L_2$, in the knitted weave shown in FIG. 1. In this case, it is desirable that the reed of the elastic yarn is moved such that the elastic yarn is arranged along a straight line parallel to the wale direction in a relaxed knitted fabric.

A sinker loop of the nonelastic yarn in the satin net in accordance with the present invention connects two elastic yarns such that the nonelastic yarn is twined around the elastic yarn arranged along a straight line parallel to the wale direction in a relaxed knitted fabric, and the nonelastic yarn extends from a sinker loop side of an elastic yarn to a sinker loop side of another elastic yarn, to form the sinker loop of the nonelastic yarn. In this satin net, when the nonelastic yarn is knitted with the elastic yarn, two elastic yarns inserted with a zigzag shape under a stretched condition over two or more knitting needles in the same sinker loops is returned to a straight line after knitting, and thus the nonelastic yarn is stretched, so that the sinker loop of the nonelastic yarn extended over two elastic yarns is formed.

A sinker loop of a nonelastic yarn connecting two adjacent elastic yarns in the power net in accordance with the present invention is formed from a needle loop side of an elastic yarn to a sinker loop side of another elastic yarn, or vice versa.

Figure 2:
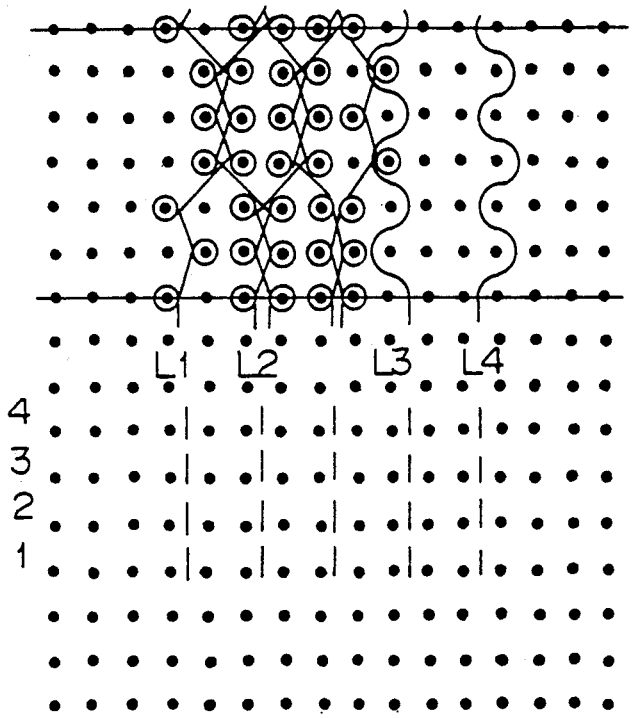
FIG. 2 is a knitting weave view illustrating an example of a power net used for the elastic warp knitting fabric in accordance with the present invention.
Figure 3:
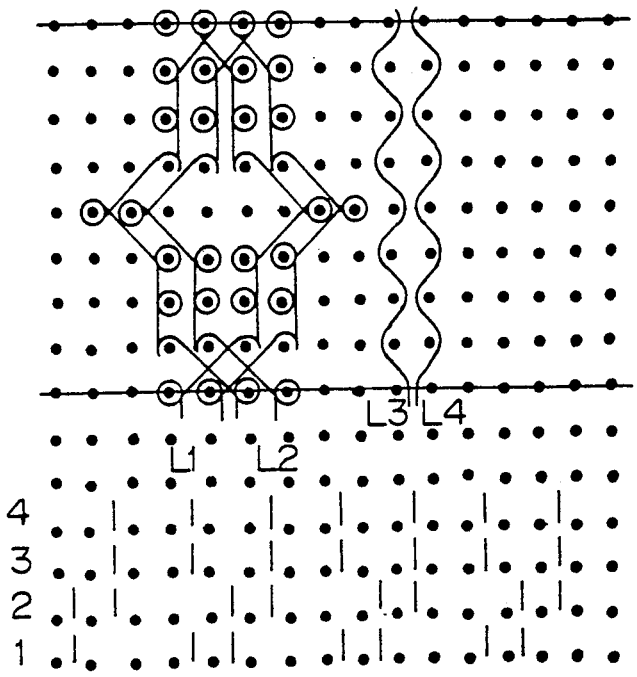
FIG. 3 is a knitting weave view illustrating another example of the power net used for the elastic warp knitting fabric in accordance with the present invention.

Various knitting weaves can be used as the power net, as in various examples described in the embodiments described hereafter, and further, the knitting weaves shown in FIGS. 2 and 3 can be used. The knitting weave shown in FIG. 2 can be knitted by supplying, for example, a nylon yarn to the reeds $L_1$ and $L_2$, and a polyurethane elastic yarn to the reeds $L_3$ and $L_4$. The knitting weave shown in FIG. 3 may be knitted by supplying the nylon yarn to the reeds $L_1$ and $L_2$, and the polyurethane elastic yarn to the reeds $L_3$ and $L_4$.

The bulge shape of the nonelastic yarn in the elastic warp knitted fabric is easily eliminated by a tension applied upon a winding operation of the knitting machine, a tension applied upon a dyeing operation, and a heat set operation with a stretching operation in a lateral direction of the knitted fabric, and thus made a plain shape. Accordingly, it is necessary to select a suitable condition of the operations. A pulling out force of pulling out the elastic yarn at the pulling speed of 10 m/min from the warp knitting fabric is 30 g or more, preferably between 40 g and 80 g.

Since the nonelastic yarn holds the elastic yarn firmly in the knitted fabric, a fabric distortion caused by a dislocation of the elastic yarn in a ground knitted weave does not occur, even if the stretching operation is repeated. When the pulling out force is under 30 g, since it is impossible to firmly hold the elastic yarn in the ground knitted weave by the nonelastic yarn, the fabric distortion is generated by a repeating stretching operation of the knitted fabric, and thus this knitted fabric cannot be used as clothes. When the pulling out force is over 80 g, the force holding the elastic yarn applied by the nonelastic yarn becomes too strong and the knitted fabric loses a stretchability thereof, and thus the elastic yarn may be broken by the nonelastic yarn.

A shape of the sinker loop of the nonelastic yarn in the elastic warp knitted fabric in accordance with the present invention must further satisfy the following equations (1) and (2).

$$\frac{L_0(\max) - L_0(\min)}{L_0(\text{mean})} \times 100 < 15 \quad (1)$$

$$\frac{\Sigma\left(\frac{L - L_0}{L_0}\right)}{15} \times 100 > 4 \quad (2)$$

wherein; $L_0$, $L_0(\max)$, $L_0(\min)$, $L_0(\text{mean})$ and L are measure by the following method.

An electron micrograph of a cross section of the elastic warp knitted fabric is taken at the magnitude of 50 to obtain an enlarged view of the sinker loop. Three position, i.e., a center position and each position remote from each side of the knitted fabric by 30 cm, are selected as positions to be taken with the electron micrograph, and values of $L_0$ and L of five sinker loops for the three positions are measured, respectively.

$L_0$: a distance between two points formed by that perpendicular lines projecting from each center of two adjacent elastic yarns toward a straight line connecting the each center of the two adjacent elastic yarns toward a straight line connecting the each center of the two adjacent elastic yarns are crossed with a curve arranged substantially in a middle portion of a sinker loop of the nonelastic yarn, $L_0(\max)$: a maximum value of fifteen value of $L_0$, $L_0(\min)$: a minimum value of the fifteen value of $L_0$, $L_0(\text{mean})$: a mean value of the fifteen value of $L_0$, L: a length of a segment of a curve arranged substantially in a middle portion of a sinker loop of the nonelastic yarn which is cut by two perpendicular lines projecting from each center of two adjacent elastic yarns toward a straight line connecting each center of the two adjacent elastic yarn.

When the equation (1) is satisfied, the elastic warp knitted fabric becomes a knitted fabric having a high quality, due to no distortion of the fabric.

It is preferable that the smaller the value of $$\frac{L_0(\max) - L_0(\min)}{L_0(\text{mean})},$$

the better, but a practically useful value of $$\frac{L_0(\max) - L_0(\min)}{L_0(\text{mean})} \times 100$$

is between 5 and 13, in consideration of a residual strain of the knitted fabric generated by a tension applied to a yarn.

A value of $$\frac{\Sigma\left[\frac{L - L_0}{L_0}\right]}{15} \times 100$$

is referred to as a bulge index hereafter.

A preferable bulge index of the satin net is between and 10. When the bulge index is over 10, a floating state of the sinker loop becomes large, a snagging phenomenon is likely to be generated, and thus a lower luster, a high thickness of the knitted fabric and an inferior dimensional stability are generated on the knitted fabric. When the bulge index is less than 4, the elongation of the knitted fabric becomes lower and a handling of the knitted fabric becomes paper-like, and thus a knitted fabric having a high quality cannot be obtained.

A preferable bulge index of the power net is of between 5 and 10. When the bulge index is over 10, the same disadvantages as those of the satin net appear, and when the bulge index is less than 5, the elongation of the knitted fabric becomes lower and a handling of the knitting fabric becomes paper-like, and thus a knitted fabric having a high quality cannot be obtained.

The elastic warp knitted fabric having the abovedescribed constitution has a larger elongation in a course direction compared with a conventional elastic warp knitted fabric, i.e. 80% or more.

When inner wear or the like is manufactured by sewing the elastic warp knitted fabric in accordance with the present invention, it is possible to make the inner wear easily able to be put on and taken off by using a course direction of the knitted fabric as a traverse direction of the inner wear, and a fitting of the inner wear to a human body can be improved.

If the course direction of the knitted fabric having the course elongation of less than 80% is used as the traverse direction of the inner wear or the like, an unnatural force will be applied to a sewing portion of the inner wear or the like, due to the lower course elongation, and thus a slipping out of the elastic yarn from the sewing portion is generated and an unpreferable distortion of fabric is likely to be generated.

A preferable ratio of a wale elongation against a course elongation of the elastic warp knitted fabric in accordance with the present invention is between 1.0 and 2.0 for the satin net and between 1.0 and 1.6 for the power net.

A method of manufacturing the elastic warp knitted fabric in accordance with the present invention will be described hereafter.

First, grey fabric of an elastic warp knitted fabric is knitted in such a manner that the elastic yarn is inserted into sinker loops of a ground knitted weave constituted by a nonelastic yarn, by a warp knitting machine.

Next, a relaxation treatment using at least one selected from a group of steam, water and air is applied to the grey fabric in a dyeing machine, using a flowing gas as an energy of propelling a fabric, a wet heat process comprising a scouring treatment and a dyeing treatment is applied to the relaxed grey fabric in the flowing gas dyeing machine, and finally, a finishing set is applied to the obtained knitted fabric.

The relaxation treatment to the grey fabric by the flowing gas dyeing machine must be determined in such a manner that the sinker loop of the nonelastic yarn pressed and made flat by a tension at a winding operation of the grey fabric in the warp knitting machine is not fixed by a later heat set process, and a time and a temperature of the relaxation process must be carefully set up in order to attain a sufficient relaxation.

Japanese Examined Patent Publications (Kokoku) No. 63-29030 and No. 63-36385, and Europe Patent Publication No. 78022 disclose a flowing gas dyeing machine.

Figure 4:
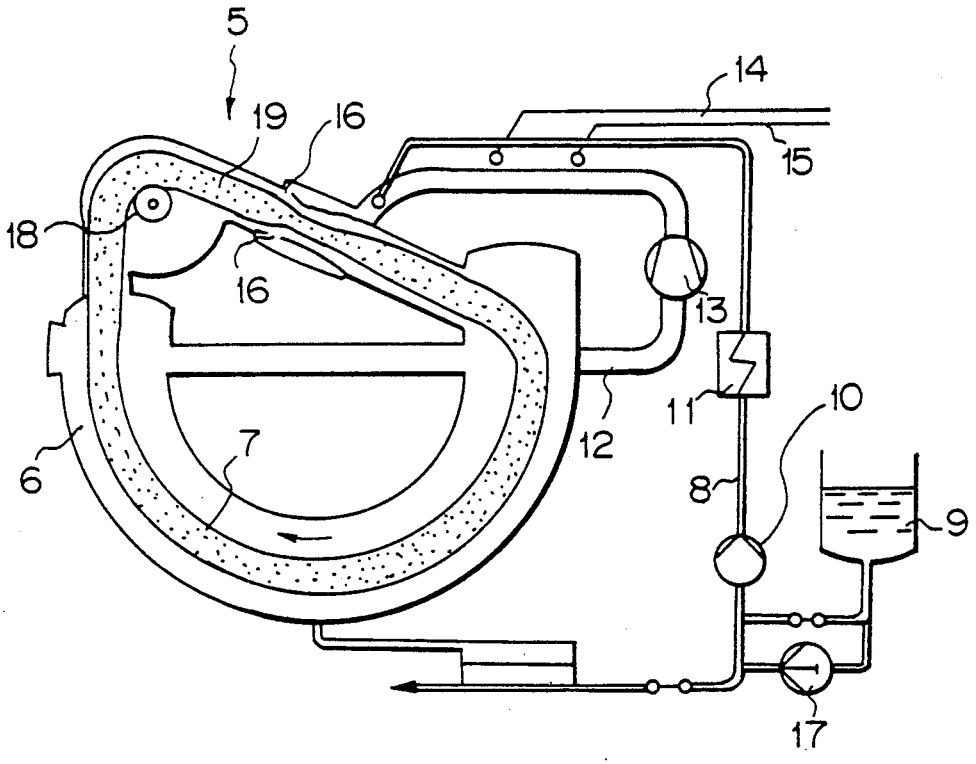
FIG. 4 is a schematical front view illustrating an example of a machine used for obtaining the elastic warp knitting fabric in accordance with the present invention.

An example of the flowing gas dyeing machine is shown in FIG. 4. In the flowing gas dyeing machine 5, a knitted fabric 7 sewn to as endless form is circulated through a guiding roller 18 in a vessel 6. A dyeing liquid is circulated from the vessel 6 through an injection circuit 8 having an injection pump and a heat exchanger 11. A gas in the vessel 6 is also circulated through a gas circuit 12 having a blower 13. Compressed air and vapor is supplied from pipes 14 and 15. The dyeing liquid with the gas is injected from a nozzle 16 arranged around the knitted fabric 7, and thus the knitted fabric can be moved in a direction of an arrow.

The numeral 17 denotes a metering pump and 9 a tank of the dyeing liquid.

The relaxation treatment is preferably applied at the temperature of between 60° C. and 100° C. for between 1 min and 20 min. It is possible to remove an inherent strain of the grey fabric and eliminate an irregularity of a density in every portions of the grey fabric.

If necessary, a preset treatment may be applied to a satin net to prevent creases applied in the dyeing treatment and a deformation of a dimension of the knitted fabric. It is preferable to use a lower temperature and a small tentering ratio in the preset treatment of the satin net. A preferable tentering ratio measured on the basis of the relaxed grey fabric is around 20% and a preferable temperature is of between 150° C. and 180° C. for the grey fabric using a polyamide multifilament as the nonelastic yarn.

The dyeing operation must be applied by the flowing gas dyeing machine in which the tension is not applied to the grey fabric. As described herebefore, the grey fabric in the flowing gas dyeing machine is propelled by a flowing gas or a blending stream of a gas and a liquid. If necessary, the grey fabric may be propelled with an additional device such as a supplemental reel.

It is possible to make a volume of the dyeing liquid held in the knitted fabric too small, and thus minimize a necessary energy to propel the knitted fabric by using the flowing gas dyeing machine. Accordingly, since an unnatural force is not apply to the knitted fabric when a gas and/or a liquid heated at a high temperature is in contact with the knitted fabric, the following effects are expected.

(1) A uniform rubbing effect can be applied, and thus there is little irregularly of the density between a center portion and both selvages.

(2) A generation of a rope-like crease is held, and thus an elastic warp knitted fabric satisfying the equation (1) and having superior quality level is obtained.

(3) Since a force to be applied in a wale direction i.e., a direction of the elastic yarn, is held to a minimum value, an elastic warp knitted fabric having a sufficient power and in which a lowering of the denier of the elastic yarn does not occur can be obtained.

The dyeing operation is applied with a conventional temperature, time and processing agent.

Note that when a sinker loop of the elastic yarn is fully stretched and fixed, even if the flowing gas dyeing machine is used only for the dyeing treatment, the elastic warp knitted fabric in accordance with the present invention cannot be obtained.

On the contrary, even if the relaxation treatment is applied with the flowing gas dyeing machine and the preset treatment is applied with the conditions according to the present invention, when the dyeing treatment is applied by a dyeing machine in which an excess tension is applied to the knitted fabric e.g., a conventional flowing liquid dyeing machine, a rope crease is generated on the knitting fabric in the dyeing treatment, and thus the elastic warp knitting machine which does not satisfy the equation (1) and having an inferior appearance and distortion of fabric may be unpreferably obtained.

Finally, a final set treatment is applied to remove the creases generated in the previous treatments, adjust irregularity of the dimension and improve dimensional stability. For this treatment, a conventional machine having a pin or a clip and capable of applying a hot air such as a tenter is used. If necessary a processing agent can be used for improving a handling, a water absorption property or a prevention of static electricity. In this treatment, a tentering must be determined to be small enough to retain the bulge shape of the sinker loop of the nonelastic yarn. A preferable tentering ratio measured on the basis of the dyed fabric is around 10% and a preferable temperature is of between 150° C. and 180° C. for the fabric using a polyamide multifilament as the nonelastic yarn.

The present invention is not limited by the abovedescribed conditions in each treatment, and the conditions of the treatments to be used can be optionally determined according to a specification of a final product made of the elastic warp linitted fabric in accordance with the present invention.

The present invention will be described in detail by the following examples and comparative examples.

Before the description of the examples, a method of measuring the characteristics of the knitted fabric used in the examples will be described.

1. L and $L_0$, expressing a bulge of the sinker loop of the nonelastic yarn, are measured by the following method.

An electron micrograph of a cross section of the elastic warp knitted fabric is taken at the magnitude of 50 to obtain an enlarged view of the sinker loop. Three position, i.e., a center position and each position remote from each side of the knitted fabric by 30 cm, are selected as positions to be taken with the electron micrograph and values of $L_0$ and L of five sinker loops for the three positions are measured, respectively.

$L_0$: a distance between two points formed by that perpendicular lines projecting from each center of two adjacent elastic yarns toward a straight line connecting the each center of the two adjacent elastic yarns are crossed with a curve arranged substantially in a middle portion of a sinker loop of the nonelastic yarn, $L_0$(max): a maximum value of fifteen value of $L_0$, $L_0$(min): a minimum value of the fifteen value of $L_0$(mean): a mean value of the fifteen value of $L_0$, L: a length of a segment of a curve arranged substantially in a middle portion of a sinker loop of the nonelastic yarn which is cut by two perpendicular lines projecting from each center of two adjacent elastic yarns toward a straight line connecting the each center of the two adjacent elastic yarn.

2. Elongation of the knitted fabric

A load of 2.25 kg is applied to a rectangular test piece of a knitted fabric having a width of 2.5 cm, by a TENSILON UTM-3-100 Tensile Tester, and the elongation of the knitted fabric is expressed as a ratio of the stretched length against an original length of the test piece.

Three positions i.e. a center portion and each position remote from each side of the knitted fabric by 30 cm, are selected as positions to be prepared with test pieces, and three test pieces are prepared in each position, respectively, and thus nine test pieces are prepared.

3. Power of the knitted fabric

A power of the knitted fabric is measured by the following method.

The same size test pieces as those used in the measurement of the elongation of the knitted fabric are used. Three stretching operations of stretching by an elongation of 80% and releasing operations thoseof are repeated by using a TENSILON UTM-3-100 Tensile Tester. The power of the knitted fabric is expressed by a value of stress per 2.5 cm width appearing in the tester when the elongation of the knitted fabric becomes 50% after a third stretching operation.

4. Pulling out force for pulling out an elastic yarn

Figure 13A:
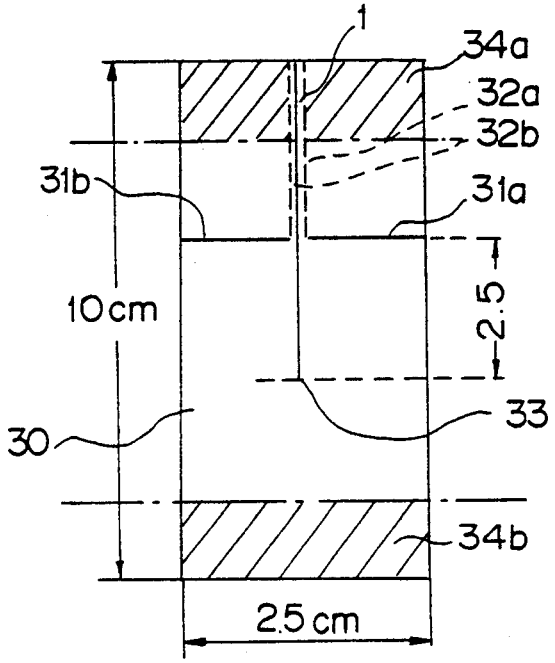
FIG. 13(A) is a front view of a test piece to be used for measuring a pulling out force for pulling out an elastic yarn from the elastic warp knitting fabric.
Figure 13B:
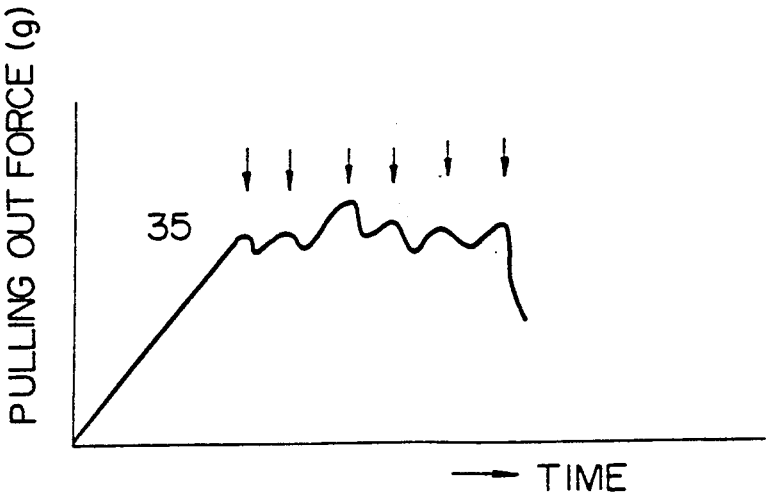
FIG. 13(B) is a graph illustrating a curve of the pulling out force, of the elastic yarn.

As shown in FIG. 13 (A), a test piece 30 having the length of 10 cm and the width of 2.5 cm, is prepared. As shown as lines 31*a*, 31*b*, 32*a*, 32*b*, the test piece 30 is cut to pick up one elastic yarn 1, and a lower end of the elastic yarn 1 is cut at a point 33, and thus a lower portion of the elastic yarn 1 is held in the knitted fabric having a length of 2.5 cm. Both end portions 34*a*, 34*b* are grasped by grippers of a TENSILON UTM-3-100 Tensile Tester and the lower portion of the elastic yarn is pulled out from the knitted fabric. FIG. 13 (B) shows a curve 35 of the pulling out force.

The pulling out force is expressed by mean value of each stress expressed by each arrow in the curve 35.

5. Burst strength of the elastic warp knitting fabric. A test is conducted according to JIS L-1018, 1096 Mullen-type method.

6. Tear strength of the elastic warp knitting fabric A test is conducted according to JIS L-1018, 1096 Single-Tongue method.

7. A distortion of a knitted fabric is measured by de Mattia type stretch tester. Four test pieces having the length of 11 cm and the width of 9 cm are prepared. Both end portions having the length of 2 cm are graped by grippers of the teser, and thus a portion having the length of 7 cm and along which the plurality of elastic yarn are arranged is applied with a stretching and removing operation. Namely, Ten thousand stretching operations of stretching the test piece by an elongation of 100% and releasing operations thoseof are repeated at the speed of 200 per minute, and then the distortion of the knitted fabric are observated.

8. In this invention, another method of evaluating a bulge shape of a nonelastic yarn is used as a reference.

Figure 14A:
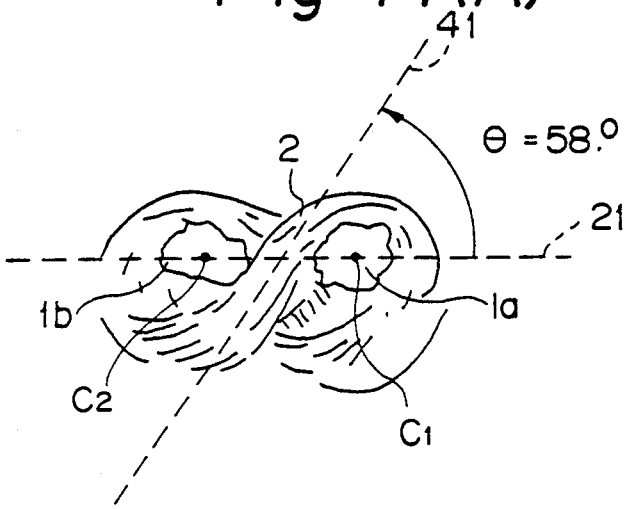
FIG. 14 is views illustrating another method of evaluating a bulge shape of the nonelastic yarn in the satin net, wherein FIG. 14 (A) shows an example having a good bulge shape and FIG. 14 (B) shows an example having a poor bulge shape.
Figure 14B:
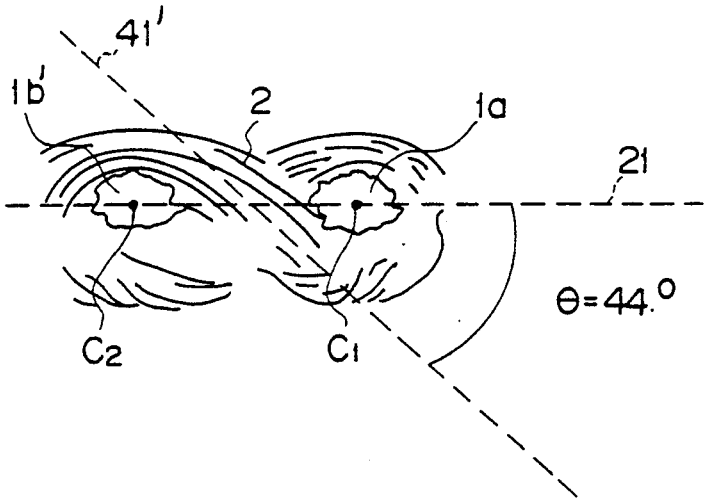
Figure 15A:
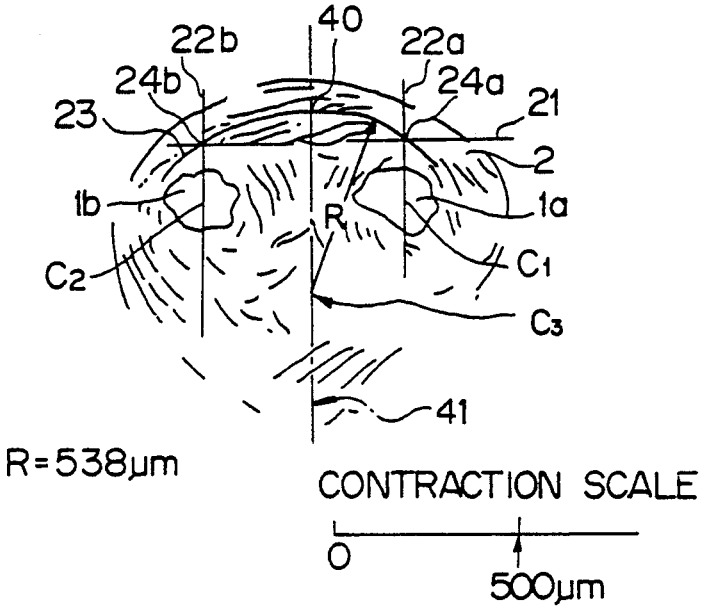
FIG. 15 is views illustrating another method of evaluating a bulge shape of the nonelastic yarn in the power net, wherein FIG. 15 (A) snows an example having a good bulge shape and FIG. 15 (B) shows an example having a poor bulge shape.
Figure 15B:
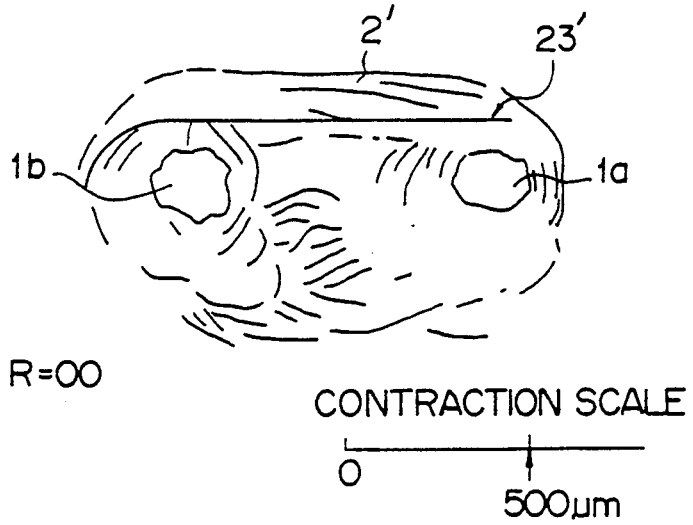

Namely, an angle ($\theta$) of the sinker loop is used for evaluating the bulge shape of the nonelastic yarn in a power net, as shown in FIG. 14(A) and FIG. 14(B), and a radius of curvature of the sinker loop is used for evaluating the bulge shape of the nonelastic yarn in a satin net, as shown in FIG. 15(A) and FIG. 15(B).

Namely, an electron micrograph of a cross section of the power net is taken at the magnitude of 50 to obtain an enlarged view of the sinker loop. A straight line 21 connecting a center $C_1$ of an elastic yarn 1*a* and a center $C_2$ of an adjacent elastic yarn 1*b* is drawn on the enlarged view, and another straight line 41 is drawn in a middle portion of a nonelastic yarn 2 as shown in FIG. 14 (A). An angle between the straight line 21 and the straight line 41 is measured and is expressed as a value evaluating the bulge shape of the nonelastic yarn of the power net.

FIG. 14 (A) shows an example having a superior bulge shape of the sinker loop in the power net in accordance with the present invention, and FIG. 14 (B) shows an example having an inferior bulge shape of the power loop in the satin net.

FIGS. 15 (A) and 15 (B) shows an electron micrograph of a cross section of the satin net, and is used for measuring a radius of curvature of the sinker loop. Vertical straight lines 22*a* and 22*b* passing through centers $C_1$ and $C_2$ of the elastic yarns 1*a* and 1*b* are drawn in a enlarged view. A radius R of curvature of a false circle connecting a point 24*a* where a middle curved line 23 of the nonelastic yarn 2 is crossed with the vertical straight line 22*a* to a point 24*b* where the middle curved line 23 of the nonelastic yarn 2 is crossed with the vertical straight line 22*b* is measured and is expressed as a value evaluating the bulge shape of the nonelastic yarn of the satin net.

Namely, a normal 41 is drawn on a center 40 of the middle curved line 23, a center $C_3$ of the false circle similar to the middle curved line 23 in shape is determined on the normal 41 and a distance between the center $C_3$ and the center 40 is measured as the radius R.

FIG. 15 (A) shows an example having a superior bulge shape of the sinker loop in the satin net in accordance with the present invention, and FIG. 15 (B) shows an example having an inferior bulge shape of the sinker loop in the satin net.

EXAMPLE 1

Nylon 66 drawn multifilament 50 denier/17 filaments having a cross section of Y and a tensile strength of 6 g/d is supplied to a front reed, and a polyurethane elastic yarn 280 denier is supplied to a back reed, and a satin net having the following six course satin net knitted weave is knitted by a raschel knitting machine having a needle pitch of 28 per inch.

L1: 24/42/24/20/02/20//
L2: 66/22/44/00/44/22//
Length of runner
L1: 112 cm/rack
L2: 8 cm/rack The obtained grey fabric having a width of 220 cm and the length of 50 m is supplied to a flowing air dyeing machine AF-30 supplied from THEN Co., to apply a relaxation treatment.

The grey fabric is heated by raising a temperature of the dyeing machine to 50° C. under a condition that the grey fabric is only rotated at the speed of 100 m/min by air, is crumpled for 5 min, and then the temperature of the dyeing machine is raised to 60° C. by supplying steam, the grey fabric is further crumpled for 5 min, and supplied with a hot water having the temperature of 60° C. and finally, the temperature of the dyeing machine is further raised to 80° C. to apply a relaxation treatment for 1 min. A width of the relaxed grey fabric is 145 cm. This grey fabric is applied with a preset treatment of a tentering width of 150 cm and a temperature of 170° C., and then the following scoaring treatment and dyeing treatment are further applied to the grey fabric by using the flowing air dyeing machine AF-30 supplied from THEN

Scouring

Scouring agent: scourol FC-250 2 g/L
Hot water: 60° C. 80 liter (bath ratio of 1 to 3)
Speed of the knitted fabric: 100 m/min
Scouring treatment applied for 20 min, and then rinsed with a water for 10 min.

Dyeing

Dyestuff: Acid dyestuff, an alizarin brilliant light blue 4GL 1% owf
Leveling agent: Newbon TS 0.5 g/liter
Acetic acid: 0.2 g/liter
Temperature elevation ratio from 30° C. to 95° C.: 2° C./min
Speed of the knitted fabric: 100 m/min
Dyeing treatment: for 30 min at 95° C.
Temperature lowering ratio from 95° C. to 60° C.: 4° C./min
Rinsing: for 10 min after draining the dyeing liquid

Soaping

A soaping treatment is applied with the same condition as that used in the scouring treatment. A width of the elastic warp knitted fabric is 140 cm. A final set treatment having a tentering width of 150 cm and a temperature of 180° C. is applied to the dyed knitted fabric. The weight per unit area of the obtained knitted fabric is 200 g/m$^2$, and this knitted fabric is a superior elastic warp knitted fabric having a balance such as 1.7 between the wale elongation and the course elongation.

Figure 5:
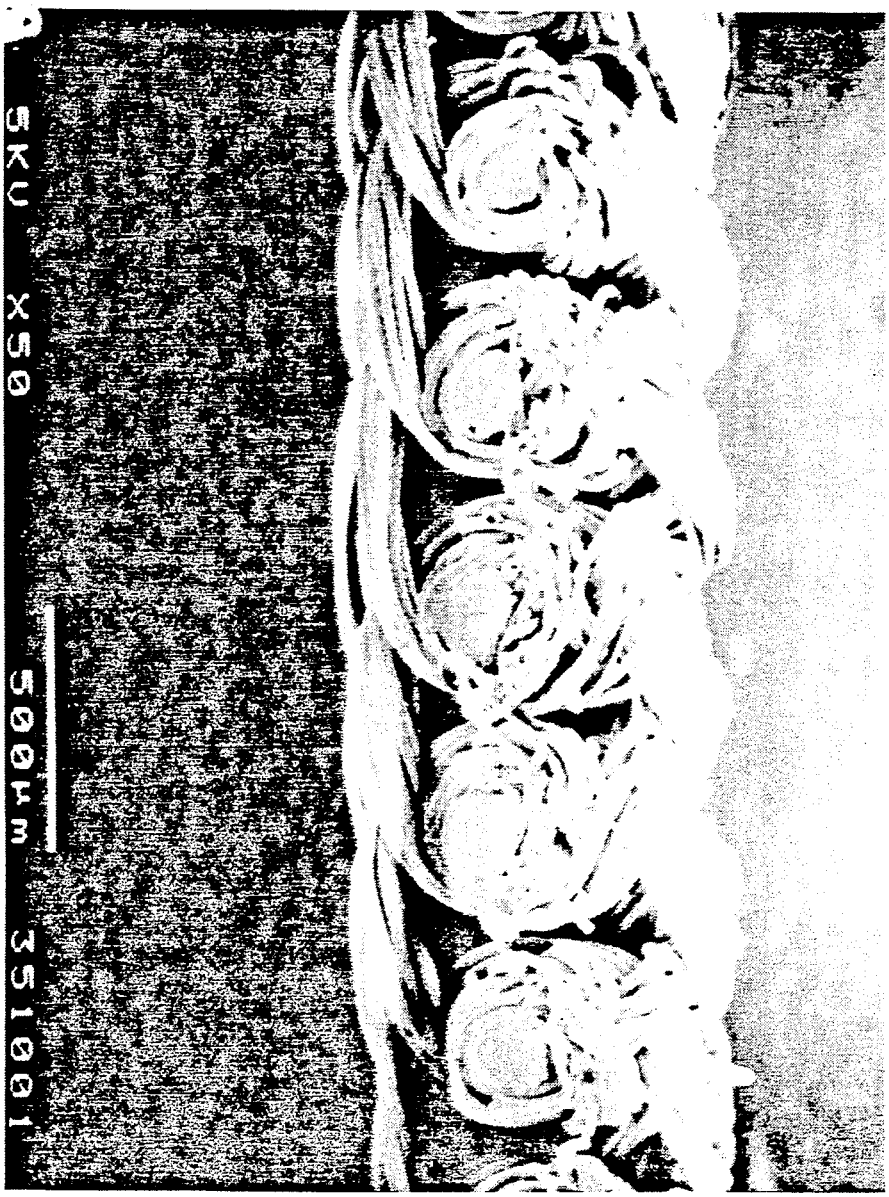
FIG. 5 is an electron micrograph illustrating a section of a six course satin net corresponding to Example 1 of the elastic warp knitting fabric in accordance with the present invention.
Figure 7:
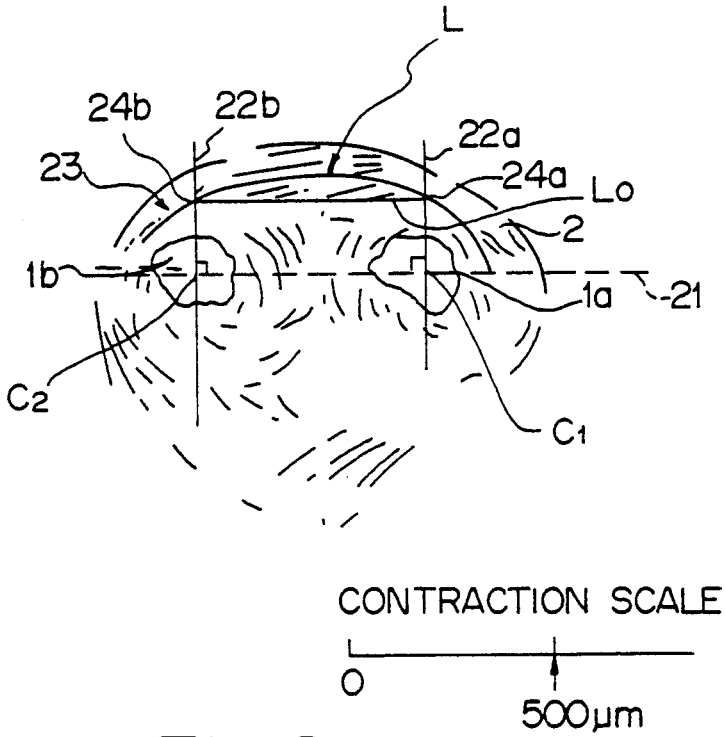
FIG. 7 is a schematic cross section view illustrating a bulge shape of a sinker loop in the six course satin net corresponding to FIG. 5.

An electron micrograph illustrating a section of the elastic warp knitted fabric obtained is shown in FIG. 5 and a schematically enlarged cross section of the bulge shape of the sinker loop is shown in FIG. 7. As shown in FIGS. 5 and 7, the sinker loop has a curve between the two adjacent elastic yarns and is bulged.

An elongation of the fabric, a balance between a wale elongation and a course elongation, a bulge ratio of a sinker loop of the nonelastic yarn, a coefficient of variation of the bulge ratio, a denier of the polyurethane elastic yarn pulled out from the knitted fabric, a destortion, and a power of the knitted fabric in the Example 1 are shown in Table 1.

EXAMPLE 2

The same grey fabric as that used in Example 1 is applied with a relaxation treatment conditions which are the same as that in Example 1, and the relaxed knitted fabric having the width of 145 cm is obtained. A preset treatment having the tentering width of 145 cm and the temperature of 170° C. are applied to the above knitted fabric.

The same scouring treatment and dyeing treatment as those in Example 1 are applied to the set knitted fabric and the knitted fabric having the width of 140 cm is obtained. A final set treatment having the tentering width of 145 cm and the temperature of 170° C. is applied to obtain the knitted fabric having the weight per unit area of 215 g/m$^2$. This knitted fabric is a superior elastic warp knitted fabric having a balance such as 1.7 between the wale elongation and the course elongation.

A bulge shape of the sinker loop in a cross section of an elastic warp knitted fabric obtained has a structure such that the sinker loop is bent between two adjacent elastic yarns and is the same as that of the elastic warp knitted fabric of the Example 1.

An elongation of the fabric, a balance between a wale elongation and a course elongation, a bulge ratio of a sinker loop of the nonelastic yarn, a coefficient of variation of the bulge ratio, a denier of the polyurethane elastic yarn pulled out from the knitted fabric, a distortion, and a power of the knitted fabric in Example 2 are shown in Table 1.

EXAMPLE 3

The same grey fabric as that used in Example 1 is applied with a relaxation treatment conditions which are the same as that in Example 1, and the relaxed knitted fabric having the width of 145 cm is obtained. A preset treatment having the tentering width of 160 cm and the temperature of 170° C. are applied to the above knitted fabric.

The same scouring treatment and dyeing treatment as those in Example 1 are applied to the set knitted fabric and the knitted fabric having the width of 140 cm is obtained. A final set treatment having the tentering width of 160 cm and the temperature of 170° C. is applied to obtain the knitted fabric having the weight per unit area of 195 g/m$^2$. This knitted fabric is a superior elastic warp knitted fabric having a balance such as 1.9 between the wale elongation and the course elongation.

A bulge shape of the sinker loop in a cross section of an elastic warp knitted fabric obtained is a structure such that the sinker loop is bent between two adjacent elastic yarns and is the same as that of the elastic warp knitted fabric of the Example 1.

An elongation of the fabric, a balance between a wale elongation and a course elongation, a bulge ratio of a sinker loop of the nonelastic yarn, a coefficient of variation of the bulge ratio, a denier of the polyurethane elastic yarn pulled out from the knitted fabric, a distortion, and a power of the knitted fabric in Example 3 are shown in Table 1.

Comparative Example 1

Comparative Example 1 relates to the grey fabric used in Examples 1 to 3. A bulge shape of a sinker loop of a nonelastic yarn of the grey fabric just after a knitting operation has the same bulge shape, i.e., the shape bended between the two adjacent elastic yarn, but the sinker loop in the grey fabric is collapsed by a tension applied to the grey fabric upon winding the grey fabric and includes a partially flat portion, and a degree of variability of the bulged ratio becomes large, the grey fabric is not sufficiently relaxed, a pulling out force of the elastic yarn is lower, and distortion of fabric is likely to occur.

An elongation of the fabric, a balance between a wale elongation and a course elongation, a bulge ratio of a sinker loop of the nonelastic yarn, a coefficient of variation of the bulge ratio, a denier of the polyurethane elastic yarn pulled out from the knitted fabric, a distortion, and a power of the knitted fabric in Comparative Example 1 are shown in Table 1.

Comparative Example 2

The same grey fabric as that used in Example 1 is directly dyed in a circular type jet dyeing machine supplied from Hisaka dyeing machine Co., without a relaxation treatment and a preset treatment. The grey fabric is dyed at the temperature of 95° C., for 30 min and in the bath ratio of 1 to 15 by using the same dyeing agents as those in Example 1 to obtain the dyed knitted fabric having the width of 140 cm.

Finally, a final set treatment having the tentering width of 145 cm and the temperature of 170° C. is applied to the dyed knitted fabric to obtain the elastic warp knitted fabric having the weight per unit area of 205 g/m$^2$.

A bulge shape of the sinker loop in a cross section of an elastic warp knitted fabric obtained is a structure such that the sinker loop is bent between two adjacent elastic yarns and is the same as that of the elastic warp knitted fabric of the Example 1, but the bulge shape of the sinker loop has been disordered by a strong stream of a dyeing liquid applied to the knitted fabric during the dyeing treatment.

An elongation of the fabric, a balance between a wale elongation and a course elongation, a bulge ratio of a sinker loop of the nonelastic yarn, a coefficient of variation of the bulge ratio, a denier of the polyurethane elastic yarn pulled out from the knitted fabric, a distortion, and a power of the knitted fabric in Comparative Example 2 are shown in Table 1.

Comparative Example 3

The same grey fabric as that used in Example 1 is wound on a beam, and dyed directly in a beam dyeing machine, without a relaxation treatment and a preset treatment. The grey fabric is dyed at the temperature of 95° C. for 30 min by using the same dyeing agents as those in Example 1 to obtain the dyed knitted fabric having the width of 195 cm.

Finally, a final set treatment having a tentering width of 200 cm and the temperature of 170° C. is applied to the dyed knitted fabric to obtain the elastic warp knitted fabric having the weight per unit area of 195 g/m$^2$.

A sinker loop in a cross section of the elastic warp knitted fabric does not show a bent state, and the bulge shape of the sinker loop has been made flat by a strong stream of a dyeing liquid applied to the knitted fabric during the dyeing treatment, and thus the elastic warp knitted fabric having a paper-like hard handling is obtained.

An elongation of the fabric, a balance between a wale elongation and a course elongation, a bulge ratio of a sinker loop of the nonelastic yarn, a coefficient of variation of the bulge ratio, a denier of the polyurethane elastic yarn pulled out from the knitted fabric, a distortion, and a power of the knitted fabric in Comparative Example 3 are shown in Table 1.

Comparative Example 4

The same grey fabric as that used in Example 1 is directly scoured and dyed in the same dyeing machine as that used in the Example 1, i.e., the flowing air dyeing machine supplied from THEN Co., under the same conditions as those used in Example 1 and without a relaxation treatment and a preset treatment to obtain the dyed knitted fabric having the width of 140 cm.

Finally, a final set treatment having the tentering width of 145 cm and the temperature of 170° C. is applied to the dyed knitted fabric to obtain the elastic warp knitted fabric having the weight per unit area of 205 g/m$^2$.

A bulge shape of the sinker loop in a cross section of an elastic warp knitted fabric obtained has a structure such that the sinker loop is bent between two adjacent elastic yarns and is the same as that of the elastic warp knitted fabric of the Example 1, but the bulge shape of the sinker loop is slightly disordered by a strong steam of a dyeing liquid applied to the knitted fabric during the dyeing treatment and this disorder of the sinker loop cannot be eliminated by the final set treatment.

An elongation of the fabric, a balance between a wale elongation and a course elongation, a bulge ratio of a sinker loop of the nonelastic yarn, a coefficient of variation of the bulge ratio, a denier of the polyurethane elastic yarn pulled out from the knitted fabric, a distortion, and a power of the knitted fabric in Comparative Example 4 are shown in Table 1.

Comparative Example 5

The same grey fabric as that used in Example 1 is applied with the same relaxation treatment as those used in Example 1 (the width of the relaxed fabric is 145 cm), and with a preset treatment having the tentering width of 170 cm and the temperature of 170° C., and then is supplied to the jet dyeing machine. The dyeing treatment is applied to the knitted fabric at the temperature of 95° C. for 30 min (the width of the dyed fabric is 145 cm). Finally a final set treatment having the tentering with of 170 cm and the temperature of 170° C. is applied to the dyed knitted fabric to obtain the elastic warp knitted fabric having the weight per unit area of 205 g/m$^2$.

A bulge shape of the sinker loop in a cross section of an elastic warp knitted fabric obtained has a structure such that the sinker loop is bent between two adjacent elastic yarns and is the same as that of the elastic warp knitted fabric of the Example 1, but the bulge shape of the sinker loop has been disordered by a strong stream of a dyeing liquid applied to the knitted fabric during the dyeing treatment.

An elongation of the fabric, a balance between a wale elongation and a course elongation, a bulge ratio of a sinker loop of the nonelastic yarn, a coefficient of variation of the bulge ratio, a denier of the polyurethane elastic yarn pulled out from the knitted fabric, a distortion, and a power of the knitted fabric in Comparative Example 5 are shown in Table 1.

Comparative Example 6

The same grey fabric as that used in Example 1 is applied with the same relaxation treatment as those used in Example 1 (the width of the relaxed fabric is 145 cm), and with a preset treatment having the tentering width of 150 cm and the temperature of 140° C., and then is supplied to the jet dyeing machine. The dyeing treatment is applied to the knitted fabric at the temperature of 95° C for 30 min (the width of the dyed fabric is 140 cm). Finally a final set treatment having the tentering width of 150 cm and the temperature of 170° C. is applied to the dyed knitted fabric to obtain the elastic warp knitted fabric having the weight per unit area of 225 g/m$^2$.

A bulge shape of the sinker loop in a cross section of an elastic warp knitted fabric obtained is a structure such that the sinker loop is bent between two adjacent elastic yarns and is the same as that of the elastic warp knitted fabric of the Example 1. However, the bulge shape of the sinker loop has been disordered by a strong stream of a dyeing liquid applied to the knitted fabric during the dyeing treatment.

An elongation of the fabric, a balance between a wale elongation and a course elongation, a bulge ratio of a sinker loop of the nonelastic yarn, a coefficient of variation of the bulge ratio, a denier of the polyurethane elastic yarn pulled out from the knitted fabric, a distortion, and a power of the knitted fabric in Comparative Example 6 are shown in Table 1.

Comparative Example 7

The same grey fabric as that used in Example 1 is applied with the same relaxation treatment as those used in Example 1 (the width of the relaxed fabric is 145 cm), and with a preset treatment having the tentering width of 200 cm and the temperature of 190° C., and then is applied with the same scouring and dyeing treatment as those of Example 1 (the width of the elastic knitted fabric is 190 cm). Finally, a final set treatment having the tentering width of 200 cm and the temperature of 170° C. is applied to the dyed knitted fabric to obtain the elastic warp knitted fabric having the weight per unit area of 185 g/m$^2$.

A sinker loop in a cross section of the elastic knitted fabric does not have a bent shape and a balance between a wale elongation and a course elongation in this knitted fabric is inferior. Further the bulge shape of the sinker loop has been changed to a flat shape by a hot stream of a dyeing liquid applied to the knitted fabric during the dyeing treatment, and thus only the elastic warp knitted fabric having a paper-like hard handling can be obtained.

Figure 6:
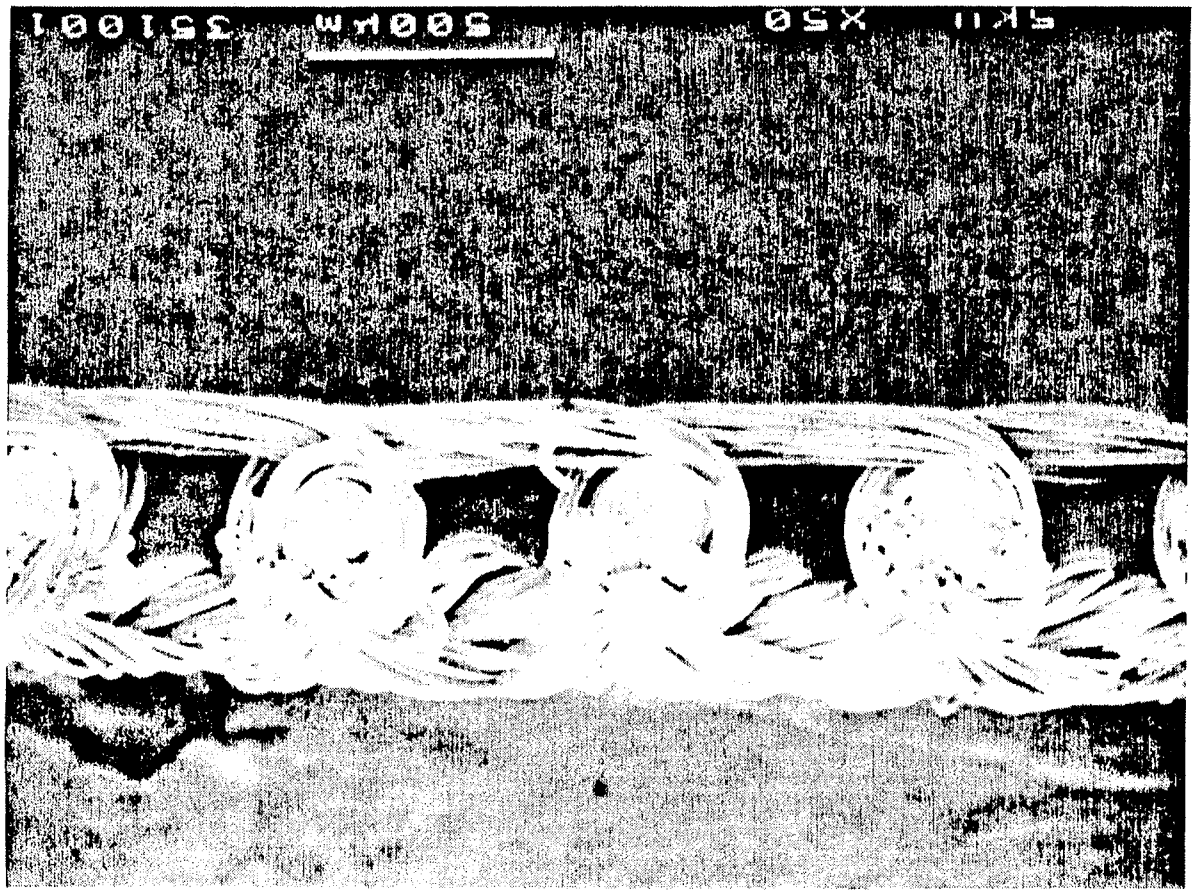
FIG. 6 is an electron micrograph illustrating a section of a six course satin net corresponding to Comparative Example 7 in the prevent invention.
Figure 8:
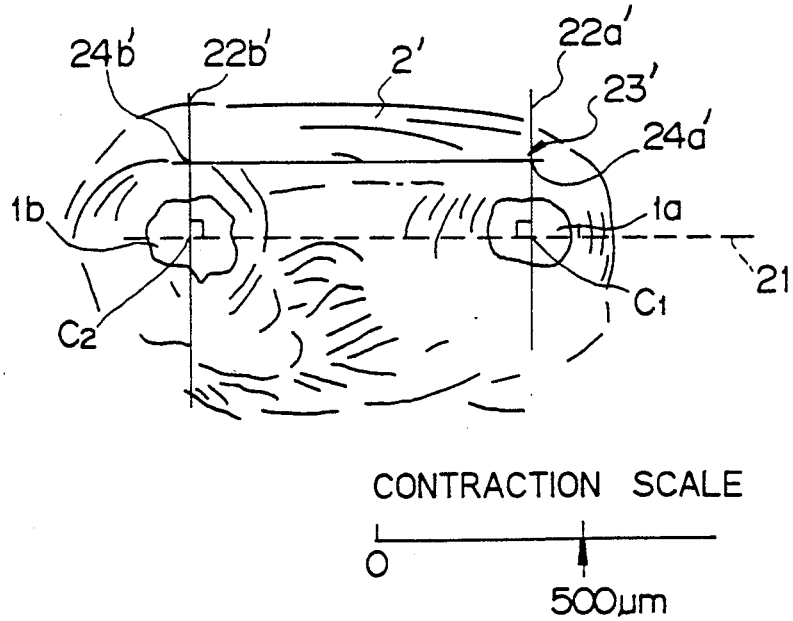
FIG. 8 is a schematic cross section view illustrating a bulge shape of a sinker loop in the six course satin net corresponding to FIG. 6.

An electron micrograph illustrating a section of the elastic warp knitted fabric obtained is shown in FIG. 6 and a schematically enlarged cross section of the bulge shape of the sinker loop is shown in FIG. 8. As shown in FIGS. 6 and 8, the sinker loop doesn't have a curve between the two adjacent elastic yarns and is bulged.

An elongation of the grey fabric, a balance between a wale elongation and a course elongation, a bulge ratio of a sinker loop of the nonelastic yarn, a coefficient of variation of the bulge ratio, a denier of the polyurethane elastic yarn pulled out from the knitted fabric, a distortion, and a power of the knitted fabric in Comparative Example 7 are shown in Table 1.

Comparative Example 8

The same grey fabric as that used applied with the same relaxation treatment as those used in Example 1 (the width of the relaxed fabric is 145 cm), and with a preset treatment having the tentering width of 200 cm and the temperature of 150° C., and then is applied with the same scouring and dyeing treatment as those of Example 1 (the width of the elastic knitted fabric is 190 cm). Finally, a final set treatment having the tentering width of 200 cm and the temperature of 170° C. is applied to the dyed knitted fabric to obtain the elastic warp knitted fabric having the weight per unit area of 185 g/m$^2$.

A sinker loop in a cross section of the elastic knitted fabric does not have a bent shape and a balance between a wale elongation and a course elongation in this knitted fabric is inferior. Further, the bulge shape of the sinker loop has been changed to a flat shape by a hot stream of a dyeing liquid applied to the knitting fabric during the dyeing treatment, and thus only the elastic warp knitted fabric having a paper-like hard handling can be obtained.

An elongation of the fabric, a balance between a wale elongation and a course elongation, a bulge ratio of a sinker loop of the nonelastic yarn, a coefficient of variation of the bulge ratio, a denier of the polyurethane elastic yarn pulled out from the knitted fabric, a distortion, and a power of the knitted fabric in Comparative Example 8 are shown in Table 1.

Comparative Example 9

The same grey fabric as that used in Example 1 is applied with the same relaxation treatment as those used in Example 1 (the width of the relaxed fabric is 145 cm), and with a preset treatment having the tentering width of 150 cm and the temperature of 190° C., and then is applied with the same scouring and dyeing treatment as those of Example 1 (the width of the dyed knitted fabric is 145 cm). Finally, a final set treatment having the tentering width of 150 cm and the temperature of 170° C. is applied to the dyed knitted fabric to obtain the elastic warp knitted fabric having the weight per unit area of 185 $g/m_2$.

A bulge shape of the sinker loop in a cross section of elastic warp knitted fabric obtained is a structure such that the sinker loop is bent between two adjacent elastic yarns and is the same as that of the elastic warp knitted fabric of the Example 1, but since the conditions used in the preset treatment are too strong, a thickness of the elastic yarn pulled out from the knitted fabric becomes too fine and the power of the knitted fabric is lowered.

An elongation of the fabric, a balance between a wale elongation and a course elongation a bulge ratio of a sinker loop of the nonelastic yarn a coefficient of variation of the bulge ratio, a denier of the polyurethane elastic yarn pulled out from the knitted fabric, a distortion, and a power of the knitted fabric in Comparative Example 9 are shown in Table 1.

Comparative Example 10

The same grey fabric as that used in Example 1 is applied with a relaxation treatment at the temperature of 95° C. for 1 min by a continuous relaxer into which the knitted fabric is supplied in a spread state (the width of the relaxed fabric is 175 cm), and with a preset treatment having the tentering width of 175 cm and the temperature of 170° C., and then is applied with the same scouring and dyeing treatment as those of Example 1 (the width of the dyed knitted fabric is 170 cm). Finally, a final set treatment having the tentering width of 180 cm and the temperature of 170° C. is applied to the dyed knitted fabric to obtain the elastic warp knitted fabric having the weight per unit area of 185 $g/m^2$.

A bulge shape of the sinker loop in a cross section of an elastic warp knitted fabric obtained is less than that of Example 1, but has a structure such that the sinker loop is bent between two adjacent elastic yarns. Further, a degree of relaxation is not sufficient in this Example, and the bulge ratio along the course direction has a large variance.

An elongation of the fabric, a balance between a wale elongation and a course elongation, a bulge ratio of a sinker loop of the nonelastic yarn, a coefficient of variation of the bulge ratio, a denier of the polyurethane elastic yarn pulled out from the knitted fabric, a distortion, and a power of the knitted fabric in Comparative Example 10 are shown in Table 1.

Comparative Example 11

The same grey fabric as that used in Example 1 is applied with a relaxation treatment at the temperature of 95° C. for 1 min by a continuous relaxer into which the knitted fabric is supplied at a spread state (the width of the relaxed fabric is 175 cm). The relaxed knitted fabric applied with a preset treatment having the tentering width of 200 cm, and the temperature of 190° C., and is dyed at the temperature of 95° C. for 30 min. by a jet dyeing machine (the width of the dyed knitting fabric is 190 cm). Finally, a final set treatment having the tentering width of 200 cm, and the temperature of 170° C. is applied to obtain the elastic warp knitted fabric having the weight per unit area of 185 $g/m^2$.

The obtained knitted fabric has the burst strength of 3.5 $kg/cm^2$ and the tear strength of 1.4 kg. A sinker loop in a cross section of the elastic warp knitted fabric does not bend and a balance between the wale elongation and the course elongation of the elastic warp knitted fabric is inferior. Further the bulge shape of the sinker loop is made flat by a hot stream of a dyeing liquid applied to the knitted fabric during the dyeing treatment, and thus only the elastic warp knitted fabric having a paper-like hard handling can be obtained.

An elongation of the fabric, a balance between a wale elongation and a course elongation, a bulge ratio of a sinker loop of the nonelastic yarn, a coefficient of variation of the bulge ratio, a denier of the polyurethane elastic yarn pulled out from the knitted fabric, a distortion, and a power of the knitted fabric in Comparative Example 11 are shown in Table 1.

Comparative Example 12

The same grey fabric as that used in Example 1 is applied with a relaxation treatment by the same method as that used in Example 1 (the width of the relaxed fabric is 145 cm). The relaxed knitted fabric is applied with a preset treatment having the tentering width of 200 cm and the temperature of 150° C., and is dyed at the temperature of 95° C. for 30 min by a jet dyeing machine (the width of the dyed knitting fabric is 180 cm). Finally, a final set treatment having the tentering width of 200 cm and the temperature of 170° C. is applied to obtain the elastic warp knitted fabric having the weight per unit area of 185 $g/m^2$.

A sinker loop in a cross section of the elastic warp knitted fabric does not bend and a balance between the wale elongation and the course elongation of the elastic warp knitted fabric is inferior. Further, the bulge shape of the sinker loop is made flat by a hot stream of a dyeing liquid applied to the knitted fabric during the dyeing treatment and thus only the elastic warp knitted fabric having a paper-like hard handling can be obtained.

An elongation of the fabric, a balance between a wale elongation and a course elongation, a bulge ratio of a sinker loop of the nonelastic yarn, a coefficient of variation of the bulge ratio, a denier of the polyurethane elastic yarn pulled out from the knitted fabric, a distortion, and a power of the knitted fabric in Comparative Example 12 are shown in Table 1.

Comparative Example 13

The same grey fabric as that used in Example 1 is applied with a relaxation treatment by the same method as that used in Example 1 (the width of the relaxed fabric is 145 cm). The relaxed knitted fabric is applied with a preset treatment having the tentering width of 150 cm and the temperature of 190° C., and is dyed at the temperature of 95° C. for 30 min by a jet dyeing machine (the width of the dyed knitting fabric is 145 cm). Finally, a final set treatment having the tentering width of 150 cm and the temperature of 170° C. is applied to obtain the elastic warp knitted fabric having the weight per unit area of 185 g/m$^2$.

A bulge shape of the sinker loop in a cross section of an elastic warp knitted fabric obtained is a structure such that the sinker loop is bent between two adjacent elastic yarns and is the same as that of the elastic warp knitted fabric of the Example 1, but since the conditions used in the preset treatment are too strong, a thickness of the elastic yarn pulled out from the knitted fabric becomes too fine and the power of the knitted fabric is lowered.

An elongation of the fabric, a balance between a wale elongation and a course elongation, a bulge ratio of a sinker loop of the nonelastic yarn, a coefficient of variation of the bulge ratio, a denier of the polyurethane elastic yarn pulled out from the knitted fabric, a distortion, and a power of the knitted fabric in Comparative Example 13 are shown in Table 1.

Comparative Example 14

The same grey fabric as that used in Example 1 is applied with a relaxation treatment by the same method as that used in Example 1 (the width of the relaxed fabric is 145 cm). The relaxed knitted fabric is applied with a preset treatment having the tentering width of 175 cm and the temperature of 170° C., and then is applied with the same scouring and dyeing treatment as those of Example 1 (the width of the dyed knitted fabric is 165 cm). Finally, a final set treatment having the tentering width of 175 cm and the temperature of 170° C. is applied to the dyed knitted fabric to obtain the elastic warp knitted fabric having the weight per unit area of 205 g/m$^2$.

A bulge shape of the sinker loop in a cross section of an elastic warp knitted fabric obtained has a structure such that the sinker loop is bent between two adjacent elastic yarns and is the same as that of the elastic warp knitted fabric of the Example 1, but, the bulge ratio of the sinker loop is 3.4%, the ratio between the wale elongation against the course elongation of the knitted fabric is 2.4, and thus the balance of elongation is inferior in this knitted fabric.

An elongation of the fabric, a balance between a wale elongation and a course elongation, a bulge ratio of a sinker loop of the nonelastic yarn, a coefficient of variation of the bulge ratio, a denier of the polyurethane elastic yarn pulled out from the knitted fabric, a distortion, and a power of the knitted fabric in Comparative Example 14 are shown in Table 1.

Comparative Example 15

The same grey fabric as that used in Example 1 is applied with a relaxation treatment by the same method as that used in Example 1 (the width of the relaxed fabric is 145 cm). The relaxed knitted fabric is applied with a preset treatment having the tentering width of 190 cm and the temperature of 170° C., and then is applied with the same scouring and dyeing treatment as those of Example 1 (the width of the dyed knitted fabric is 180 cm). Finally, a final set treatment having the tentering width of 190 cm and the temperature of 170° C. applied to the dyed knitted fabric to obtain the elastic warp knitted fabric having the weight per unit area of 195 g/m$^2$.

A bulge shape of the sinker loop in a cross section of an elastic warp knitted fabric obtained has a structure such that the sinker loop is bent between two adjacent elastic yarns and is the same as that of the elastic warp knitted fabric of the Example 1, but, the bulge ratio of the sinker loop is 1.6%, the ratio between the wale elongation against the course elongation of the knitted fabric is insufficiently 2.6, and thus the balance of elongation is inferior in this knitted fabric.

An elongation of the fabric, a balance between a wale elongation and a course elongation, a bulge ratio of a sinker loop of the nonelastic yarn, a coefficient of variation of the bulge ratio, a denier of the polyurethane elastic yarn pulled out from the knitted fabric, a distortion, and a power of the knitted fabric in Comparative Example 15 are shown in Table 1.

EXAMPLE 4

Nylon 66 drawn multifilament 50 denier/17 filaments having a cross section of Y and the tensile strength of 6 g/d is supplied to a front reed, a polyurethane elastic yarn 420 denier and a polyurethane elastic yarn 40 d are supplied to a back reed, and a satin net having the following six course satin net knitted weave is knitted by a raschel knitting machine having a needle pitch of 28 per inch.

L1: 24/42/46/42/24/20//
L2: 44/22/66/22/44/00//
L3: 22/00/22/00/22/00//

Length of runner
L1: 112 cm/rack
L2: 8 cm/rack
L3: 1.6 cm/rack

The obtained grey fabric is applied with a relaxation treatment by the same method as that used in Example 1 (the width of the relaxed grey fabric is 145 cm). The relaxed knitted fabric is applied with a preset treatment having the tentering width of 165 cm and the temperature of 170° C., and is applied with the same scouring and dyeing treatment as those of Example 1 (the width of the dyed knitted fabric is 155 cm). Finally, a final set treatment having the tentering width of 165 cm and the temperature of 180° C. is applied to the dyed knitted fabric and thus an elastic warp knitted fabric having the weight per unit area of 240 g/m$^2$ and having the ratio of the wale elongation against the course elongation of 1.1 is obtained. Especially, this knitted fabric has a superior balance between the wale elongation and the course elongation.

A bulge shape of the sinker loop in a cross section of an elastic warp knitted fabric obtained has a structure such that the sinker loop is bent between two adjacent elastic yarns and is the same as that of the elastic warp knitted fabric of the Example 1.

An elongation of the fabric, a balance between a wale elongation and a course elongation a bulge ratio of a sinker loop of the nonelastic yarn a coefficient of variation of the bulge ratio, a denier of the polyurethane elastic yarn pulled out from the knitted fabric, a distortion, and a power of the knitted fabric in Example 4 are shown in Table 1.

Comparative Example 16

The same grey fabric as that used in Example 4 is applied with a relaxation treatment by the same method as that used in Example 1 (the width of the relaxed grey fabric is 145 cm). The relaxed knitted fabric is applied with a preset treatment having the tentering width of 190 cm and the temperature of 170° C., and then is applied with the same scouring and dyeing treatment as those of Example 1 (the width of the dyed knitted fabric is 180 cm). Finally, a final set treatment having the tentering width of 190 cm and the temperature of 170° C. is applied to the dyed knitted fabric to obtain the elastic warp knitted fabric having the weight per unit area of 220 g/m$^2$.

A bulge shape of the sinker loop in a cross section of an elastic warp knitted fabric obtained has a structure such that the sinker loop is bent between two adjacent elastic yarns and is the same as that of the elastic warp knitted fabric of the Example 1, but the bulge ratio of the sinker loop is insufficiently 1.2%, the ratio between the wale elongation against the course elongation of the knitted fabric is 1.6, and thus the balance of elongation is inferior in this knitted fabric.

An elongation of the fabric, a balance between a wale elongation and a course elongation, a bulge ratio of a sinker loop of the nonelastic yarn, a coefficient of variation of the bulge ratio, a denier of the polyurethane elastic yarn pulled out from the knitted fabric, a distortion, and a power of the knitted fabric in Comparative Example 16 are shown in Table 1.

EXAMPLE 5

Nylon 66 multifilament spun by a high speed spinning method having the speed of 5.5 km/min and in which a drawing process is excluded is prepared. This nylon 66 multifilament 50 denier/17 filaments having a cross section of Y and the tensile strength of 4 g/d is supplied to reeds L1 and L2, and a polyurethane elastic yarn 280d is supplied to a back reeds L3 and L4, and a power net having the following knitted weave is knitted by a raschel knitting machine having the needle pitch of 28 per inch.

L1: 42/24/20/24/42/46//
L2: 24/42/46/42/24/20//
L3: 22/00/22/00/22/00//
L4: 00/22/00/22/00/22//
Length of runner
L1, L2: 118 cm/rack
L3, L4: 7 cm/rack The obtained grey fabric is applied with the same dyeing and finishing treatment as that used in Example 1, except that a preset treatment is omitted. The treatments such as the relaxation treatment, the scouring treatment, the dyeing treatment and the finishing treatment are subsequently applied by using the flowing air dyeing machine (the width of the dyed knitted fabric is 150 cm). Finally, a final set treatment having the tentering width of 155 cm and the temperature of 170° C. is applied to the dyed knitted fabric to obtain the elastic warp knitted fabric having the weight per unit area of 195 g/m$^2$. and a superior balance between the wale elongation and the course elongation.

Figure 9:
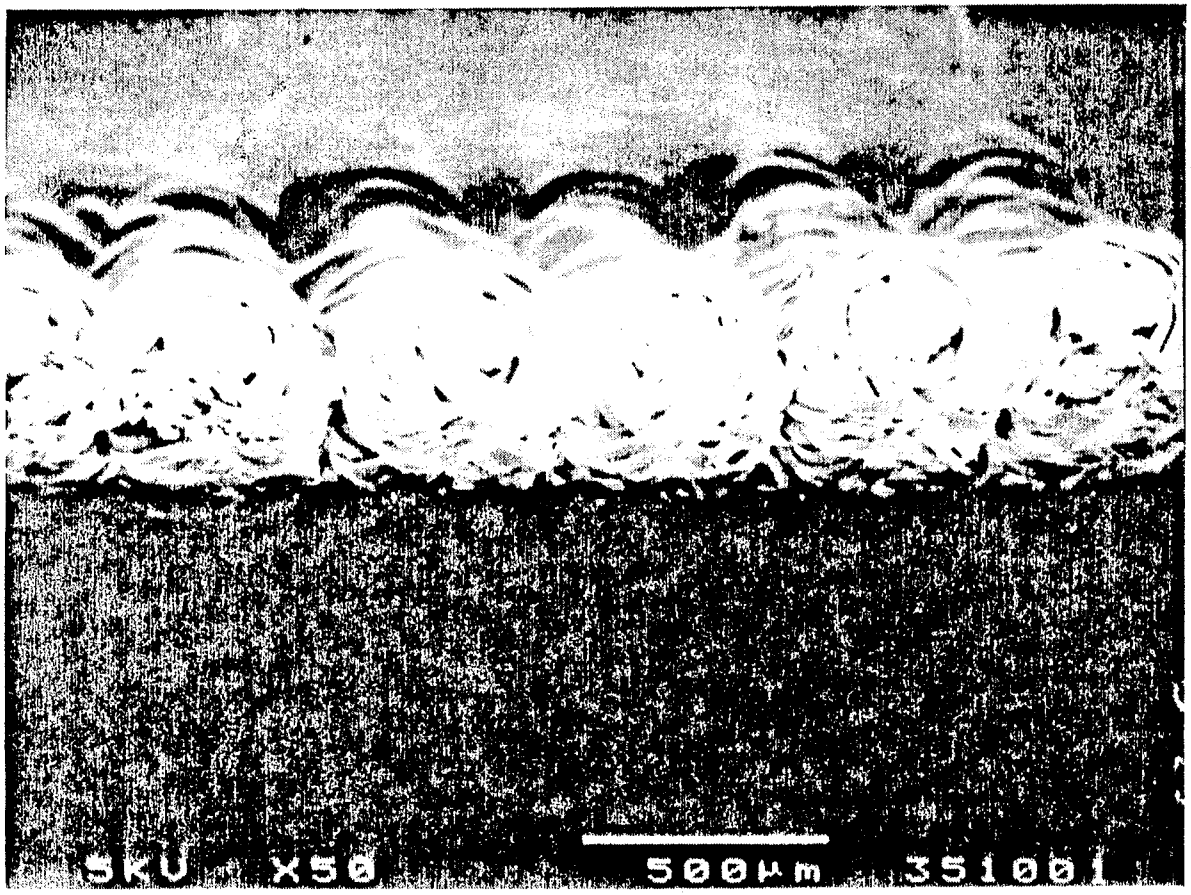
FIG. 9 is an electron micrograph illustrating a section of a power net corresponding to Example 5 of the elastic warp knitting fabric in accordance with the present invention.
Figure 11:
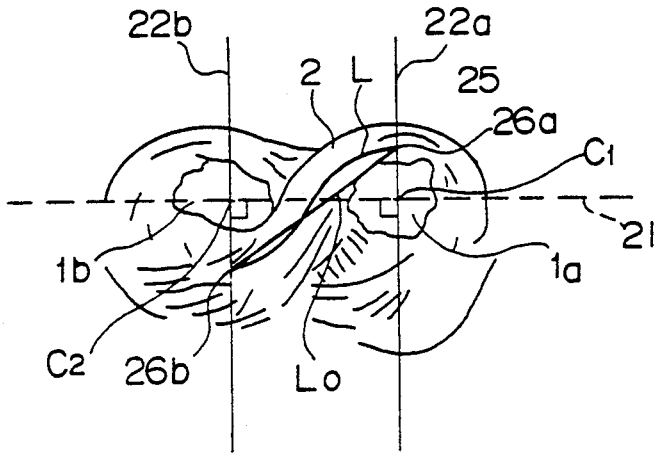
FIG. 11 is a schematic cross section view illustrating a bulge shape of a sinker loop in the power net corresponding, to FIG. 9.

An electron micrograph illustrating a section of the elastic warp knitted fabric obtained is shown in FIG. 9 and a schematically enlarged cross section of the bulge shape of the sinker loop is shown in FIG. 11. As shown in FIGS. 9 and 11, the sinker loop has a curve between the two adjacent elastic yarns and is bulged.

An elongation of the fabric, a balance between a wale elongation and a course elongation, a bulge ratio of a sinker loop of the nonelastic yarn, a coefficient of variation of the bulge ratio, a denier of the polyurethane elastic yarn pulled out from the knitted fabric, a distortion, and a power of the knitted fabric in the Example 5 are shown in Table 2.

Comparative Example 17

Comparative Example 17 relates to the grey fabric used in Example 5. A bulge shape of a sinker loop of a nonelastic yarn of the grey fabric has a structure such that the sinker loop is bent between two adjacent elastic yarns and is the same as that of the elastic warp knitted fabric of Example 5, but since a winding force applied to the knitted fabric has a large variation in a course direction, the sinker loop is likely to be collapsed, and thus a variation of the bulge ratio becomes large. Further the relaxation of the knitted fabric is insufficient, a pulling out force of the elastic yarn is lower, and a distortion of the fabric is easily generated.

An elongation of the fabric, a balance between a wale elongation and a course elongation, a bulge ratio of a sinker loop of the nonelastic yarn, a coefficient of variation of the bulge ratio, a denier of the polyurethane elastic yarn pulled out from the knitted fabric, a distortion, and a power of the knitted fabric in comparative Example 17 are shown in Table 2.

Comparative Example 18

The relaxation treatment and the preset treatment are omitted in this Comparative Example 18, and the same grey fabric as that used in Example 5 is directly supplied to a jet dyeing machine and is dyed at the temperature of 95° C. for 30 min (the width of the dyed knitted fabric is 150 cm). A final set treatment having the tentering width of 145 cm and the temperature of 170° C. is applied to the dyed warp knitted fabric to obtain an elastic knitted fabric having the weight per unit area of 195 g/m$^2$.

A bulge shape of the sinker loop in a cross section of an elastic warp knitted fabric obtained has a structure such that the sinker loop is bent between two adjacent elastic yarns and is the same as that of the elastic warp knitted fabric of the Example 5, but the bulge shape of the sinker loop is disordered by a strong stream of a dyeing liquid applied to the knitted fabric during the dyeing treatment.

An elongation of the fabric, a balance between a wale elongation and a course elongation a bulge ratio of a sinker loop of the nonelastic yarn a coefficient of variation of the bulge ratio, a denier of the polyurethane elastic yarn pulled out from the knitted fabric, a distortion, and a power of the knitted fabric in comparative Example 18 are shown in Table 2.

Comparative Example 19

In this comparative example, the relaxation treatment and the preset treatment are omitted. The same grey fabric as that used in Example 5 is wound on a beam and then put in a beam dyeing machine. The grey fabric is dyed at the temperature of 95° C. for 30 min (the width of dyed grey fabric is 190 cm). A final set treatment having the tentering width of 200 cm and the temperature of 170° C. is applied to the dyed knitting fabric to obtain an elastic warp knitted fabric having the weight per unit area of 165 g/m$^2$.

A bulge shape of the sinker loop in a cross section of an elastic warp knitted fabric is small, and a large variance of the bulge shape is generated due to a hot stream of a dyeing liquid applied to the knitted fabric during the dyeing treatment, and a handling of the knitted fabric is paper-like hard handling due to a strong tighting force of the elastic yarn.

An elongation of the fabric, a balance between a wale elongation and a course elongation, a bulge ratio of a sinker loop of the nonelastic yarn, a coefficient of variation of the bulge ratio, a denier of the polyurethane elastic yarn pulled out from the knitted fabric, a distortion, and a force of the knitted fabric in Comparative Example 19 are shown in Table 2.

Comparative Example 20

The same grey fabric as that used in Example 5 is subsequently applied with the same relaxation treatment, scouring treatment and the dyeing treatment as those used in Example 5 (the width of the dyed knitted fabric is 150 cm). A final set treatment having the tentering width of 186 cm and the temperature of 170° C. is applied to the dyed knitted fabric to obtain an elastic warp knitted fabric having the weight per unit area of 190 g/m$^2$. This knitted fabric has the ratio between the wale elongation and the course elongation of 1.6, and thus is an elastic warp knitted fabric having an inferior balance of the elongation.

A bulge shape of the sinker loop in a cross section of an elastic warp knitted fabric obtained has a structure such that the sinker loop is bent between two adjacent elastic yarns and is the same as that of the elastic warp knitted fabric of the Example 5, but a bulge ratio of the sinker loop is small such as 3.7%.

An elongation of the fabric, a balance between a wale elongation and a course elongation, a bulge ratio of a sinker loop of the nonelastic yarn, a coefficient of variation of the bulge ratio, a denier of the polyurethane elastic yarn pulled out from the knitted fabric, a distortion, and a power of the knitted fabric in Comparative Example 20 are shown in Table 2.

Comparative Example 21

The same grey fabric as that used in Example 5 is subsequently applied with the same relaxation treatment, scouring treatment and the dyeing treatment as those used in Example 5 (the width of the dyed knitted fabric is 150 cm). A final set treatment having the tentering width of 202 cm and the temperature of 170° C. is applied to the dyed knitted fabric to obtain an elastic warp knitted fabric having the weight per unit area of 170 g/m$^2$. This knitted fabric has the ratio between the wale elongation and the course elongation of 1.9, and thus is an elastic warp knitted fabric having an inferior balance of the elongation.

A bulge shape of the sinker loop in a cross section of an elastic warp knitted fabric obtained has a structure such that the sinker loop is bent between two adjacent elastic yarns and is the same as that of the elastic warp knitted fabric of the Example 5, but a bulge ratio of the sinker loop is small such as 1.8%.

Figure 10:
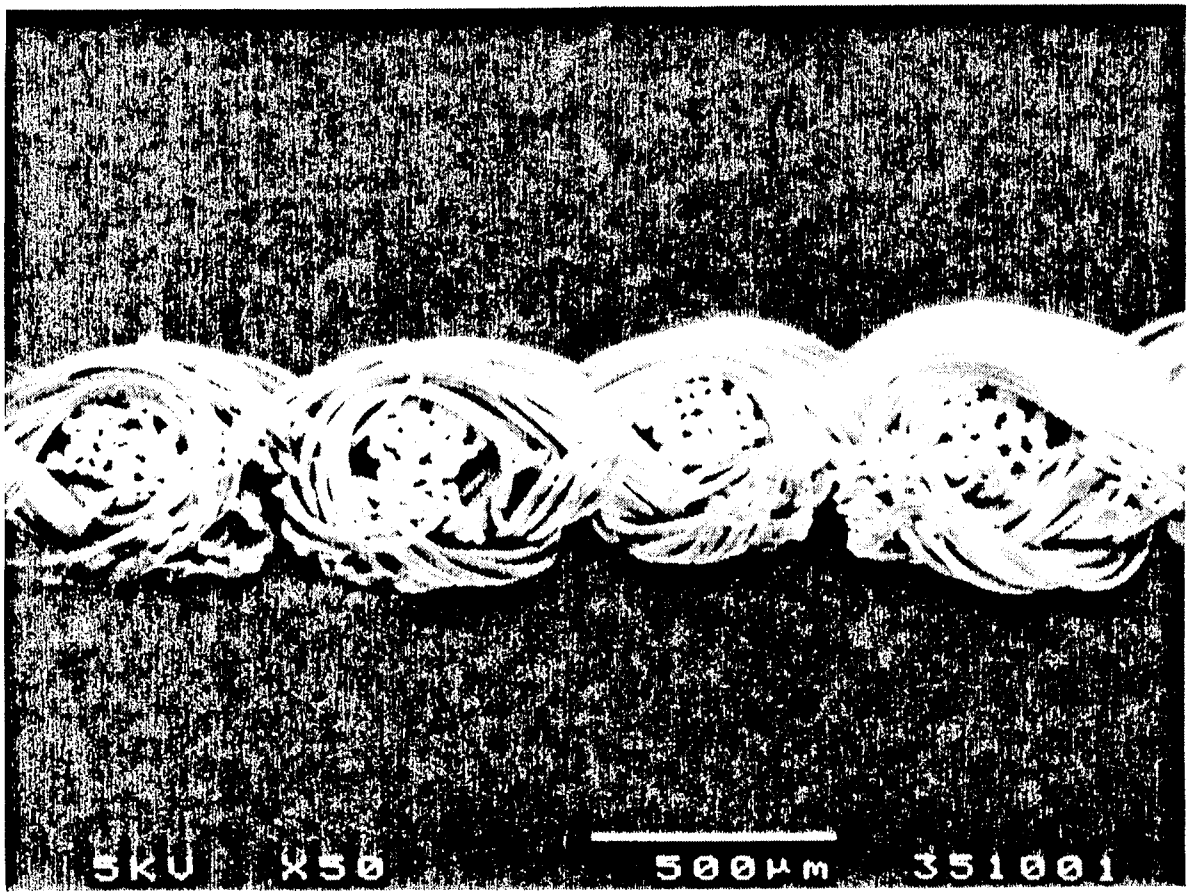
FIG. 10 is an electron micrograph illustrating a section of a power net corresponding to Comparative Example 21 in the present invention.
Figure 12:
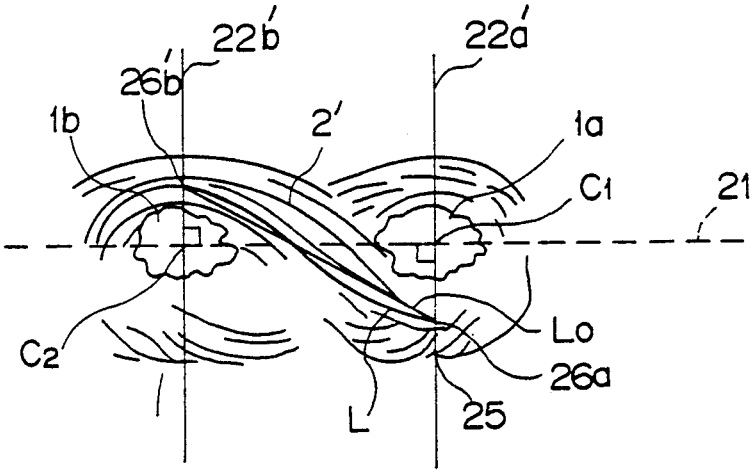
FIG. 12 is a schematic cross section view illustrating a bulge surface of a sinker loop in the power net corresponding to FIG. 10.

An electron micrograph illustrating a section of the elastic warp knitted fabric obtained is shown in FIG. 10 and a schematically enlarged cross section of the bulge shape of the sinker loop is shown in FIG. 12. As shown in FIGS. 10 and 12, the sinker loop of Comparative Example 21 doesn't have a curve between the two adjacent elastic yarns and is bulged.

An elongation of the fabric, a balance between a wale elongation and a course elongation a bulge ratio of a sinker loop of the nonelastic yarn, a coefficient of variation of the bulge ratio, a denier of the polyurethane elastic yarn pulled out from the knitted fabric, a distortion, and a power of the knitted fabric in Comparative Example 21 are shown in Table 2.

Comparative Example 22

The same grey fabric as that used in Example 5 is applied with the same relaxation treatment as that used in Example 1 (the width of the relaxed knitted fabric is 145 cm). The relaxed knitted fabric is applied with a preset treatment having the tentering width of 190 cm and the temperature of 190° C. and then applied with the same scouring and dyeing treatment as that used in Example 1 (the width of the dyed knitted fabric is 180 cm). Finally, a final set treatment having the tentering width of 190 cm and the temperature of 170° C. is applied to the dyed knitted fabric to obtain an elastic warp knitted fabric having the weight per unit area of 173 g/m$^2$.

A bulge shape of the sinker loop in a cross section of an elastic warp knitted fabric obtained has a structure such that the sinker loop is bent between two adjacent elastic yarns and is the same as that of the elastic warp knitted fabric of the Example 5, but a bulge ratio of the sinker loop is small such as 2.5%.

An elongation of the fabric, a balance between a wale elongation and a course elongation, a bulge ratio of a sinker loop of the nonelastic yarn, a coefficient of variation of the bulge ratio, a denier of the polyurethane elastic yarn pulled out from the knitted fabric, a distortion, and a power of the knitted fabric in Comparative Example 22 are shown in Table 2.

EXAMPLE 6

Nylon 66 drawn multifilament 40 denier/10 filaments having a cross section of Y and the tensile strength of 6 g/d are supplied to a front reed and a polyurethane elastic yarn 210 denier is supplied to a back reed, and a satin net having the following six course satin net knitted weave is knitted by a raschel knitting machine having the needle pitch of 28 per inch.

L1: 24/42/24/20/02/20//

L2: 66/22/44/00/44/22//

Length of runner

L1: 108 cm/rack

L2: 8 cm/rack

The obtained grey fabric is applied with a relaxation treatment by the same method as that used in Example 1 by a flowing air dyeing machine AF-30 supplied from THEN Co., (the width of the relaxed grey fabric is 145 cm). The relaxed knitted fabric is applied with a preset treatment having the tentering width of 150 cm and the temperature of 170° C., and is applied with the same scouring and dyeing treatment as those of Example 1 (the width of the dyed knitted fabric is 140 cm). Finally, a final set treatment having the tentering width of 150 cm and the temperature of 180° C. is applied to the dyed knitted fabric to obtain an elastic warp knitted fabric having the weight per unit area of 175 g/m$^2$.

The obtained elastic warp knitted fabric has the burst strength of 3.5 kg/cm$^2$ and the tear strength of 1.3 kg, and further, a bulge shape of the sinker loop in a cross section of an elastic warp knitted fabric obtained is a structure such that the sinker loop is bent between two adjacent elastic yarns and is the same as that of the elastic warp knitted fabric of the Example 1.

An elongation of the fabric, a balance between a wale elongation and a course elongation, a bulge ratio of a sinker loop of the nonelastic yarn, a coefficient of variation of the bulge ratio, a denier of the polyurethane elastic yarn pulled out from the knitted fabric and a power of the knitted fabric in Example 6 are shown in Table 3.

Comparative Example 23

The same grey fabric as that used in Example 6 is applied with a relaxation treatment at the temperature of 95° C. for 1 min by a continuous relaxer into which the knitted fabric is supplied at a spread state (the width of the relaxed fabric is 180 cm), and with a preset treatment having the tentering width of 180 cm and the temperature of 190° C., and then is applied with the same scouring and dyeing treatment as those of Example 1 (the width of the dyed knitted fabric is 170 cm). Finally, a final set treatment having the tentering width of 170 cm and the temperature of 180° C. is applied to the dyed knitted fabric to obtain the elastic warp knitted fabric having the weight per unit area of 164 g/m$^2$.

The obtained elastic warp knitted fabric has the burst strength of 3.3 kg/cm$^2$, the tear strength of 1.2 kg. Further, a nonelastic yarn does not bulge and the knitted fabric has a paper-like hard handling and an inferior fabric distortion. The polyurethane yarn pulled out from the knitted fabric is to too fine.

An elongation of the fabric, a balance between a wale elongation and a course elongation a bulge ratio of a sinker loop of the nonelastic yarn a coefficient of variation of the bulge ratio, a denier of the polyurethane elastic yarn pulled out from the knitted fabric and a power of the knitted fabric in Comparative Example 23 are shown in Table 3.

To compare a difference of an effect caused by the type of the dyeing machine, Table 3 includes a result of Comparative Example 11 using the jet dyeing machine.

As can be seen in Table 3, the knitted fabric in Example 6 using the polyurethane yarn of 210 d, which is finer than that used in Comparative Example 11, has a bigger power of the knitted fabric compared with that of the knitted fabric in Comparative Example 11. Further, Table 3 shows that a thickness of the knitted fabric in Example 6 is large, but a weight per unit area of the knitted fabric in Example 6 is relatively small and the knitted fabric having the high quality is obtained, and thus it seems that the bulge of the sinker loop of the nonelastic yarn contributes to the thickness.

EXAMPLE 7

Nylon 66 multifilament 30 denier/10 filaments manufactured by a spin-draw-take up method and having a cross section of Y and the tensile strength of 8 g/d is supplied to a front reed, and a polyurethane yarn of 210 denier is supplied to a back reed, and a satin net having the following six course satin net knitted weave is knitted by a raschel knitting machine having the needle pitch of 28 per inch.

L1: 24/42/24/20/02/20//
L2: 66/22/44/00/44/22//
Length of runner
L1: 108 cm/rack
L2: 8 cm/rack The obtained grey fabric is applied with a relaxation treatment by the same method as that used in Example 1 by a flowing air dyeing machine AF-30 supplied from THEN Co., (the width of the relaxed fabric is 145 cm). The relaxed knitted fabric is applied with a preset treatment having the tentering width of 150 cm and the temperature of 170° C., and is applied with the same scouring and dyeing treatment as those of Example 1 (the width of the dyed knitted fabric is 140 cm). Finally, a final set treatment having the tentering width of 150 cm and the temperature of 180° C. is applied to the dyed knitted fabric to obtain an elastic warp knitted fabric having the weight per unit area of 150 g/m$^2$.

The obtained elastic warp knitted fabric has the burst strength of 3 kg/cm$^2$ and the tear strength of 1.2 kg and further a bulge shape of the sinker loop in a cross section of an elastic warp knitted fabric obtained is a structure such that the sinker loop is bent between two adjacent elastic yarns and is the same as that of the elastic warp knitted fabric of the Example 1.

An elongation of the fabric, a balance between a wale elongation and a course elongation a bulge ratio of a sinker loop of the nonelastic yarn, a coefficient of variation of the bulge ratio, a denier of the polyurethane elastic yarn pulled out from the knitted fabric and a power of the knitted fabric in Example 7 are shown in Table 3.

Since the high tenacity nylon multifilament is used in the knitted fabric in Example 7, although a denier of the nylon multifilament used in Example 7 is smaller than that of the nylon multifilament used in Example 6, the knitted fabric in Example 7 shows sufficient burst strength and tear strength.

For reference the other evaluating values i.e., a radius of curvature for a satin net and an angle of the sinker loop for a power net, which are described in detail with reference to FIGS. 14 and 15, are included in Table 1 and 2.

The sinker loop of the nonelastic yarn in the elastic warp knitted fabric in accordance with the present invention is made uniform and has a specific bulge shape and high pulling out force of the elastic yarn. Accordingly the balance between the wale elongation and the course elongation is remarkably improved, and thus it is unnecessary to consider a cutting direction when a final product is manufactured from the elastic warp knitted fabric in accordance with the present invention. Further, a lowering of the power of knitted fabric caused by the dyeing and finishing process is reduced in the present invention. Accordingly it is possible to prepare the elastic warp knitted fabric having a relatively thin thickness.

Furthermore, a movement of the elastic yarn in the elastic warp knitted fabric can correspond to that of the nonelastic yarn shrunk in the dyeing and finishing process. Accordingly it is possible to provide the elastic warp knitted fabric having no fabric distortion.

TABLE 1

| (Satin Net) |
|---|
| Width of |

TABLE 1-continued

| | Preset Width (cm) | Preset Temp (°C.) | Type of Dyeing | Final Set (cm) | $\frac{L - L_0}{L_0}$ (%) | $\frac{L_0(max) - L_0(max)}{L_o(mean)}$ (%) | Pulling Force (g) |
|---|---|---|---|---|---|---|---|
| Comparative Example 1 | — | — | — | — | 6.5 | 35 | 17 |
| Comparative Example 2 | — | — | Jet | 145 | 6.5 | 30 | 40 |
| Comparative Example 3 | — | — | Beam | 200 | 0 | 8 | 25 |
| Comparative Example 4 | — | — | AF | 145 | 7.0 | 36 | 45 |
| Example 1 | 150–170 | | AF | 150 | 6.5 | 9 | 45 |
| Comparative Example 5 | 170–170 | | Jet | 170 | 5.5 | 33 | 40 |
| Comparative Example 6 | 150–140 | | Jet | 150 | 5.0 | 35 | 40 |
| Comparative Example 7 | 200–190 | | AF | 200 | 0 | 10 | 35 |
| Comparative Example 8 | 200–150 | | AF | 200 | 0 | 10 | 35 |
| Comparative Example 9 | 150–190 | | AF | 150 | 6.5 | 11 | 40 |
| Comparative Example 10 | 175–170 | | AF | 180 | 0 | 8 | 35 |
| Comparative Example 11 | 200–190 | | Jet | 200 | 0 | 9 | 27 |
| Comparative Example 12 | 200–150 | | Jet | 200 | 0 | 9 | 35 |
| Comparative Example 13 | 150–190 | | Jet | 150 | 6.5 | 29 | 40 |
| Example 2 | 145–170 | | AF | 145 | 6.1 | 9 | 45 |
| Example 3 | 160–170 | | AF | 160 | 4.1 | 10 | 40 |
| Comparative Example 14 | 175–170 | | AF | 175 | 3.4 | 10 | 40 |
| Comparative Example 15 | 190–170 | | AF | 190 | 1.6 | 9 | 35 |
| Example 4 | 165–170 | | AF | 165 | 6.4 | 9 | 55 |
| Comparative Example 16 | 190–170 | | AF | 190 | 1.2 | 8 | 53 |

| | Ratio between Wale Elong. and Course Elong. (%) | Wale Elong. (%) | Course Elong. (%) | (Satin Net) Denier of Elastic Yarn Pulled out from Knitted Fabric (d) | Power of Knitted Fabric (g/2.5 cm) | Bulge Shape | Distortion | Radius of Curvature (μm) |
|---|---|---|---|---|---|---|---|---|
| Comparative Example 1 | 1.7 | 187 | 110 | 280 | 310 | YES | YES | 580 |
| Comparative Example 2 | 1.7 | 162 | 95 | 250 | 280 | " | NO | 530 |
| Comparative Example 3 | 3.1 | 192 | 62 | 200 | 200 | NO | YES | ∞ |
| Comparative Example 4 | 1.7 | 160 | 94 | 260 | 300 | YES | NO | 520 |
| Example 1 | 1.7 | 145 | 85 | 250 | 300 | " | " | 538 |
| Comparative Example 5 | 1.8 | 148 | 82 | 245 | 270 | YES | " | 710 |
| Comparative Example 6 | 2.0 | 152 | 76 | 240 | 265 | " | " | 765 |
| Comparative Example 7 | 3.1 | 193 | 62 | 210 | 230 | NO | " | ∞ |
| Comparative Example 8 | 3.5 | 217 | 62 | 210 | 230 | " | " | ∞ |
| Comparative Example 9 | 1.7 | 146 | 85 | 213 | 255 | YES | " | 550 |
| Comparative Example 10 | 3.8 | 220 | 62 | 234 | 253 | NO | " | ∞ |
| Comparative Example 11 | 3.5 | 215 | 62 | 208 | 200 | " | YES | ∞ |
| Comparative Example 12 | 3.5 | 210 | 62 | 210 | 220 | " | NO | ∞ |
| Comparative Example 13 | 1.7 | 145 | 85 | 210 | 250 | YES | " | 540 |
| Example 2 | 1.7 | 160 | 94 | 250 | 300 | " | " | 650 |
| Example 3 | 1.9 | 160 | 82 | 245 | 270 | " | " | 930 |
| Comparative Example 14 | 2.4 | 177 | 73 | 240 | 265 | " | " | 1050 |
| Comparative | 2.6 | 170 | 65 | 220 | 230 | NO | " | ∞ |

TABLE 1-continued

| | | | | | | | | |
|---|---|---|---|---|---|---|---|---|
| Example 15 | | | | | | | | |
| Example 4 | 1.1 | 9 | 84 | 390 | 276 | YES | " | 580 |
| Comparative Example 16 | 1.6 | 110 | 69 | 320 | 240 | NO | " | ∞ |

TABLE 2

(Power Net)

| | Preset Width (cm) | Preset Temp (°C.) | Type of Dyeing | Width of Final Set (cm) | $\frac{O - L_0}{L_0}$ (%) | $\frac{L_0(max) - L_0(max)}{L_0(mean)}$ (%) | Pulling Force (g) |
|---|---|---|---|---|---|---|---|
| Comparative Example 17 | — | — | — | — | 6.5 | 35 | 17 |
| Comparative Example 18 | — | — | Jet | 145 | 6.9 | 29 | 40 |
| Comparative Example 19 | — | — | Beam | 200 | 2.5 | 30 | 30 |
| Example 5 | — | — | AF | 155 | 7.3 | 12 | 45 |
| Comparative Example 20 | — | — | AF | 186 | 3.7 | 10 | 40 |
| Comparative Example 21 | — | — | AF | 202 | 1.8 | 10 | 35 |
| Comparative Example 22 | 190 | 190 | AF | 190 | 2.5 | 8 | 25 |

(Power Net)

| | Ratio between Wale Elong. and Course Elong. (%) | Wale Elong. (%) | Course Elong. (%) | Denier of Elastic Yarn Pulled out from Knitted Fabric (d) | Power of Knitted Fabric (g/2.5 cm) | Distortion | Angle of Sinker Loop(0) |
|---|---|---|---|---|---|---|---|
| Comparative Example 17 | 1.7 | 255 | 150 | 280 | 190 | YES | 50 |
| Comparative Example 18 | 1.2 | 158 | 135 | 253 | 232 | NO | 73 |
| Comparative Example 19 | 2.1 | 170 | 100 | 206 | 190 | " | 42 |
| Example 5 | 1.2 | 156 | 130 | 256 | 230 | " | 58 |
| Comparative Example 20 | 1.6 | 176 | 110 | 235 | 190 | " | 45 |
| Comparative Example 21 | 1.9 | 173 | 96 | 220 | 180 | " | 42 |
| Comparative Example 22 | 2.1 | 175 | 83 | 206 | 192 | YES | 44 |

TABLE 3

| | Preset Width (cm) | Preset Temp (°C.) | Type of Dyeing | Width of Final Set (cm) | $\frac{O - L_0}{L_0}$ (%) | $\frac{L_0(max) - L_0(max)}{L_0(mean)}$ (%) | Pulling Force (g) |
|---|---|---|---|---|---|---|---|
| Example 6 | 150 | 170 | AF | 150 | 6.3 | 8 | 42 |
| Comparative Example 23 | 180 | 190 | AF | 170 | 6.1 | 22 | 34 |
| Comparative Example 11 | 200 | 190 | JET | 200 | 0 | 9 | 27 |
| Example 7 | 150 | 170 | AF | 150 | 7 | 7 | 40 |

| | Ratio between Wale Elong. and Course Elong. (%) | Wale Elong. (%) | Course Elong. (%) | Denier of Elastic Yarn Pulled out from Knitted Fabric (d) | Power of Knitted Fabric (g/2.5 cm) | Thickness of Grey Fabric (nm) | Weight per Unit Area ($g/m^2$) |
|---|---|---|---|---|---|---|---|
| Example 6 | 1.2 | 134 | 112 | 187 | 224 | 0.53 | 175 |
| Comparative Example 23 | 3.8 | 209 | 55 | 161 | 193 | 0.52 | 176 |
| Comparative Example 11 | 3.5 | 215 | 62 | 208 | 200 | 0.50 | 185 |
| Example 7 | 1.2 | 156 | 130 | 185 | 220 | 0.50 | 150 |

Claims:

1. An elastic warp knitted fabric in which an elastic yarn is inserted to sinker loops of a ground knitted weave constituted by a nonelastic yarn, wherein the elastic warp knitted fabric is knitted so that the following conditions a and b are satisfied:

a. a pulling out force for pulling out the elastic yarn at a pulling speed of 10 cm/min from the warp knitted fabric is 30 g or more;

b. a shape of the sinker loop of the nonelastic yarn in the warp knitted fabric satisfies the following equations (1) and (2):

$$\frac{L_0(\max) - L_0(\min)}{L_0(\text{mean})} \times 100 < 15 \quad (1)$$

$$\frac{\Sigma\left\{\frac{L - L_0}{L_0}\right\}}{15} \times 100 > 4 \quad (2)$$

wherein: $L_0$, $L_0$(max), $L_0$(Min), $L_0$(mean) and L are measured by the following method:

an electron micrograph of a cross section of the elastic warp knitted fabric is taken at a magnitude of 50, to obtain an enlarged view of the sinker loop, three positions, i.e., a center position and a position remote from each side of the knitted fabric by 30 cm, are selected as positions to be taken by the electron micrograph, and values of $L_0$ and L of five sinker loops for the three positions are measured, respectively, $L_0$: a distance between two points formed by that perpendicular lines projecting from each center of two adjacent elastic yarns toward a straight line connecting each center of two adjacent elastic yarns are crossed with a curve arranged substantially in a middle portion of a sinker loop of the nonelastic yarn, $L_0$(max): a maximum value of fifteen value of $L_0$, $L_0$(min): a minimum value of the fifteen value of $L_0$, $L_0$(mean): a mean value of the fifteen value of $L_0$, L: a length of a segment of a curve arranged substantially in a middle portion of a sinker loop of the nonelastic yarn which is cut by two perpendicular lines projecting from each center of two adjacent elastic yarns toward a straight line connecting each center of the two adjacent elastic yarns.

2. An elastic warp knitted fabric, according to claim 1, wherein the elastic warp knitted fabric is a satin net having a value expressed by the equation (2) of 4 or more.

3. An elastic warp knitted fabric according to claim 2, wherein a ratio of a wale elongation against a course direction of the satin net is of between 1.0 and 2.0.

4. An elastic warp knitted fabric according to claim 1, wherein the elastic warp knitted fabric is a power net having a value expressed by the equation (2) of 5 or more.

5. An elastic warp knitted fabric according to claim 4, wherein a ratio of a wale elongation against a course direction of the power net is of between 1.0 and 1.6.

6. An elastic warp knitted fabric according to claim 1, wherein the elastic yarn is a polyurethane group elastic yarn.

7. An elastic warp knitted fabric according to claim 1, wherein the nonelastic yarn is a polyamide multifilament.

8. An elastic warp knitted fabric according to claim 7, wherein the nonelastic yarn is a high tenacity nylon multifilament having a tensile of between 7 g/d and 10 g/d.

9. An elastic warp knitted fabric according to claim 1, wherein the pulling out force of the elastic yarn is between 40 g and 80 g.

10. A method of manufacturing an elastic warp knitted fabric by which an elastic yarn is inserted to sinker loops of a ground knitted weave constituted by a nonelastic yarn, wherein a grey fabric of the elastic warp knitted fabric is knitted in such a manner that the elastic yarn is inserted to sinker loops of a ground knitted weave constituted by a nonelastic yarn by a warp knitting machine, a relaxation treatment using at least one selected from a group of steam, water and air is applied to the grey fabric in a dyeing machine using a flowing gas as an energy of propelling a fabric, a wet heat precess comprising a scouring treatment and a dyeing treatment is applied to the relaxed fabric in the flowing gas dyeing machine, and finally, a finishing set is applied to the knitted fabric obtained.

11. A method of manufacturing an elastic warp knitted fabric according to claim 10, wherein elastic warp knitted fabric is a satin net and a preset treatment is further applied to the relaxed fabric.

12. A method of manufacturing an elastic warp knitted fabric according to claim 11, wherein the nonelastic yarn of the satin net is a nylon multifilament and the temperature of the preset treatment is between 150° C. and 180° C.

* * * * *

UNITED STATES PATENT AND TRADEMARK OFFICE

CERTIFICATE OF CORRECTION

PATENT NO. : 5,250,351

DATED : October 5, 1993

INVENTOR(S) : Kondou et al.

It is certified that error appears in the above-identified patent and that said Letters Patent is hereby corrected as shown below:

Claim 1, column 33, line 2, change "cm/min" to --m/min--.

Claim 1, column 33, line 16, change "Min" to --min--.

Claim 1, column 33, line 34, change "fifteen value" to --the fifteen values--.

Claim 1, column 33, line 35, change "value" to --values--.

Claim 1, column 33, line 37, change "value" to --values--.

Claim 10, column 34, line 26, change "none-" to --non--- and line 27 change "lastic" to --elastic--.

Claim 10, column 34, line 34, change "pre-" to --pro--.

Signed and Sealed this

Tenth Day of May, 1994

Bruce Lehman

*Attest:*

BRUCE LEHMAN

*Attesting Officer*

*Commissioner of Patents and Trademarks*